US008845394B2

(12) United States Patent
Duescher

(10) Patent No.: US 8,845,394 B2
(45) Date of Patent: Sep. 30, 2014

(54) BELLOWS DRIVEN AIR FLOATATION ABRADING WORKHOLDER

(71) Applicant: Wayne O. Duescher, Roseville, MN (US)

(72) Inventor: Wayne O. Duescher, Roseville, MN (US)

( * ) Notice: Subject to any disclaimer, the term of this patent is extended or adjusted under 35 U.S.C. 154(b) by 225 days.

(21) Appl. No.: 13/662,863

(22) Filed: Oct. 29, 2012

(65) Prior Publication Data

US 2014/0120804 A1 May 1, 2014

(51) Int. Cl.
*B24B 37/30* (2012.01)

(52) U.S. Cl.
USPC ..... 451/41; 451/285; 451/288; 451/287; 451/397; 451/398

(58) Field of Classification Search
CPC ..... B24B 7/04; B24B 7/228; B24B 37/30; B24B 37/32; B24B 49/16; B24B 37/04; B24B 41/061
USPC ..... 451/41, 285–290, 397–398
See application file for complete search history.

(56) References Cited

U.S. PATENT DOCUMENTS

| | | | | |
|---|---|---|---|---|
| 1,799,332 | A * | 4/1931 | Stevens | 15/97.1 |
| 4,593,495 | A | 6/1986 | Kawakami et al. | |
| 4,918,870 | A | 4/1990 | Torbert et al. | |
| 5,205,082 | A | 4/1993 | Shendon et al. | |
| 5,364,655 | A | 11/1994 | Nakamura et al. | |
| 5,365,700 | A * | 11/1994 | Sawada et al. | 451/28 |
| 5,421,768 | A | 6/1995 | Fujiwara et al. | |
| 5,443,416 | A | 8/1995 | Volodarsky et al. | |
| 5,569,062 | A | 10/1996 | Karlsrud et al. | |
| 5,597,346 | A | 1/1997 | Hemple, Jr. | |
| 5,643,053 | A | 7/1997 | Shendon | |
| 5,643,067 | A | 7/1997 | Katsuoka et al. | |
| 5,647,789 | A * | 7/1997 | Kitta et al. | 451/41 |
| 5,681,215 | A * | 10/1997 | Sherwood et al. | 451/388 |
| 5,683,289 | A | 11/1997 | Hemple, Jr. | |
| 5,738,574 | A | 4/1998 | Tolles et al. | |
| 5,769,697 | A | 6/1998 | Nishio | |
| 5,795,215 | A * | 8/1998 | Guthrie et al. | 451/286 |

(Continued)

OTHER PUBLICATIONS

Wayne O. Duescher, Three-point spindle-supported floating abrasive platen, U.S. Appl. No. 12/661,212, filed Mar. 12, 2010. Earliest Publication No. US 20110223835 A1 Earliest Publication Date: Sep. 15, 2011.

(Continued)

*Primary Examiner* — George Nguyen
(74) *Attorney, Agent, or Firm* — Mark A. Litman & Associates, P.A.

(57) ABSTRACT

Flat-surfaced workpieces such as semiconductor wafers are attached to a rotatable floating workpiece holder carrier rotor that is supported by and rotationally driven by a bellows. The wafer carrier rotor is contained by a set of idlers that are attached to a stationary rotor housing to provide support against abrading forces that are imposed on the wafer by the moving abrasive coating on a rotary platen. The idlers allow low-friction operation of the abrading system to be provided at the very high abrading speeds used in high speed flat lapping with raised-island abrasive disks. The system is also well suited for lapping optical devices and rotary seals and for chemical mechanical planarization (CMP) polishing of wafers using resilient pads. Pressurized air is injected into the bellows device to provide uniform abrading pressure across the full surface of the wafer. Wafers can be attached to the workpiece carrier with vacuum.

19 Claims, 9 Drawing Sheets

(56) References Cited

U.S. PATENT DOCUMENTS 5,800,254 A 9/1998 Motley et al.
5,851,140 A * 12/1998 Barns et al. ..... 451/288
5,860,853 A * 1/1999 Hasegawa et al. ..... 451/285
5,874,318 A 2/1999 Baker et al.
5,910,041 A 6/1999 Duescher
5,913,714 A * 6/1999 Volodarsky et al. ..... 451/41
5,913,718 A * 6/1999 Shendon ..... 451/288
5,916,009 A 6/1999 Izumi et al.
5,944,583 A 8/1999 Cruz et al.
5,964,651 A 10/1999 Hose
5,967,882 A 10/1999 Duescher
5,975,997 A 11/1999 Minami
5,985,093 A 11/1999 Chen
5,989,104 A 11/1999 Kim et al.
5,993,298 A 11/1999 Duescher
5,993,302 A 11/1999 Chen et al.
6,019,670 A * 2/2000 Cheng et al. ..... 451/56
6,027,398 A 2/2000 Numoto et al.
6,048,254 A 4/2000 Duescher
6,050,882 A 4/2000 Chen
6,056,632 A 5/2000 Mitchel et al.
6,066,030 A * 5/2000 Uzoh ..... 451/41
6,074,277 A 6/2000 Arai
6,080,050 A 6/2000 Chen et al.
6,083,090 A * 7/2000 Bamba ..... 451/288
6,089,959 A 7/2000 Nagahashi
6,093,088 A * 7/2000 Mitsuhashi et al. ..... 451/285
6,102,777 A * 8/2000 Duescher et al. ..... 451/36
6,113,468 A * 9/2000 Natalicio ..... 451/41
6,116,993 A 9/2000 Tanaka
6,120,352 A 9/2000 Duescher
6,126,993 A 10/2000 Orcel et al.
6,132,298 A 10/2000 Zuniga et al.
6,146,259 A 11/2000 Zuniga et al.
6,149,506 A * 11/2000 Duescher ..... 451/59
6,165,056 A 12/2000 Hayashi et al.
6,168,506 B1 1/2001 McJunken
6,179,956 B1 1/2001 Nagahara et al.
6,183,354 B1 2/2001 Zuniga et al.
6,196,903 B1 * 3/2001 Kimura ..... 451/285
6,217,411 B1 * 4/2001 Hiyama et al. ..... 451/8
6,217,433 B1 4/2001 Herrman et al.
6,251,215 B1 6/2001 Zuniga et al.
6,270,392 B1 8/2001 Hayashi et al.
6,299,741 B1 10/2001 Sun et al.
6,361,420 B1 3/2002 Zuniga et al.
6,371,838 B1 4/2002 Holzapfel
6,390,901 B1 5/2002 Hiyama et al.
6,390,905 B1 5/2002 Korovin et al.
6,394,882 B1 5/2002 Chen
6,398,906 B1 6/2002 Kobayashi et al.
6,425,809 B1 7/2002 Ichimura et al.
6,436,828 B1 8/2002 Chen et al.
6,439,965 B1 8/2002 Ichino
6,443,821 B1 9/2002 Kimura et al.
6,447,368 B1 9/2002 Fruitman et al.
6,491,570 B1 12/2002 Sommer et al.
6,506,105 B1 1/2003 Kajiwara et al.
6,558,232 B1 5/2003 Kajiwara et al.
6,585,567 B1 7/2003 Black et al.
6,592,434 B1 7/2003 Vanell et al.
6,607,157 B1 * 8/2003 Duescher ..... 242/417.3
6,659,850 B2 12/2003 Korovin et al.
6,672,949 B2 1/2004 Chopra et al.
6,716,094 B2 * 4/2004 Shendon et al. ..... 451/288
6,729,944 B2 5/2004 Birang et al.
6,752,700 B2 6/2004 Duescher
6,761,618 B1 * 7/2004 Leigh et al. ..... 451/11
6,769,969 B1 8/2004 Duescher
6,805,613 B1 * 10/2004 Weldon et al. ..... 451/6
6,837,779 B2 1/2005 Smith et al.
6,893,332 B2 5/2005 Castor
6,896,584 B2 5/2005 Perlov et al.
6,899,603 B2 5/2005 Homma et al.
6,899,607 B2 5/2005 Brown
6,899,609 B2 5/2005 Hong
6,935,013 B1 8/2005 Markevitch et al.
7,001,251 B2 2/2006 Doan et al.
7,001,257 B2 2/2006 Chen et al.
7,008,303 B2 3/2006 White et al.
7,014,535 B2 3/2006 Custer et al.
7,018,906 B2 3/2006 Chen et al.
7,029,380 B2 4/2006 Horiguchi et al.
7,033,251 B2 4/2006 Elledge
7,044,838 B2 5/2006 Maloney et al.
7,081,042 B2 7/2006 Chen et al.
7,101,273 B2 9/2006 Tseng et al.
7,125,313 B2 10/2006 Zelenski et al.
7,144,304 B2 12/2006 Moore
7,147,541 B2 12/2006 Nagayama et al.
7,166,016 B1 1/2007 Chen
7,250,368 B2 7/2007 Kida et al.
7,276,446 B2 10/2007 Robinson et al.
7,292,427 B1 11/2007 Murdoch et al.
7,294,041 B1 * 11/2007 Lee et al. ..... 451/8
7,357,699 B2 4/2008 Togawa et al.
7,367,867 B2 5/2008 Boller
7,393,790 B2 7/2008 Britt et al.
7,419,910 B2 9/2008 Minamihaba et al.
7,422,634 B2 9/2008 Powell et al.
7,445,847 B2 11/2008 Kulp
7,446,018 B2 11/2008 Brogan et al.
7,452,817 B2 11/2008 Yoon et al.
7,456,106 B2 11/2008 Koyata et al.
7,456,107 B2 11/2008 Keleher et al.
7,470,169 B2 12/2008 Taniguchi et al.
7,485,028 B2 2/2009 Wilkinson et al.
7,485,241 B2 2/2009 Schroeder et al.
7,488,235 B2 2/2009 Park et al.
7,488,236 B2 2/2009 Shimomura et al.
7,488,240 B2 2/2009 Saito
7,491,116 B2 2/2009 Sung
7,491,342 B2 2/2009 Kamiyama et al.
7,507,148 B2 3/2009 Kitahashi et al.
7,510,974 B2 3/2009 Li et al.
7,520,798 B2 4/2009 Muldowney et al.
7,520,800 B2 4/2009 Duescher
7,527,271 B2 5/2009 Oh et al.
7,527,722 B2 5/2009 Sharan
7,553,214 B2 6/2009 Menk et al.
7,568,970 B2 8/2009 Wang
7,572,172 B2 8/2009 Aoyama et al.
7,579,071 B2 8/2009 Huh et al.
7,582,221 B2 9/2009 Netsu et al.
7,601,050 B2 10/2009 Zuniga et al.
7,614,939 B2 11/2009 Tolles et al.
7,618,529 B2 11/2009 Ameen et al.
7,632,434 B2 12/2009 Duescher
7,648,410 B2 1/2010 Choi
7,699,684 B2 4/2010 Prasad
7,708,621 B2 5/2010 Saito
7,731,568 B2 6/2010 Shimomura et al.
7,741,656 B2 6/2010 Nakayama et al.
7,753,761 B2 7/2010 Fujita
7,754,611 B2 7/2010 Chen et al.
7,762,870 B2 7/2010 Ono et al.
7,807,252 B2 10/2010 Hendron et al.
7,822,500 B2 10/2010 Kobayashi et al.
7,833,907 B2 11/2010 Anderson et al.
7,837,800 B2 11/2010 Fukasawa et al.
7,838,482 B2 11/2010 Fukasawa et al.
7,840,305 B2 11/2010 Behr et al.
7,883,397 B2 2/2011 Zuniga et al.
7,884,020 B2 2/2011 Hirabayashi et al.
7,897,250 B2 3/2011 Iwase et al.
7,922,783 B2 4/2011 Sakurai et al.
7,947,190 B2 5/2011 Brown
7,950,985 B2 5/2011 Zuniga et al.
7,955,964 B2 6/2011 Wu et al.
7,972,396 B2 7/2011 Feng et al.
8,002,860 B2 8/2011 Koyama et al.
8,021,215 B2 9/2011 Zuniga et al.
8,025,813 B2 9/2011 Liu et al.
8,029,640 B2 10/2011 Zuniga et al.

(56) References Cited

U.S. PATENT DOCUMENTS

| | | | | |
|---|---|---|---|---|
| 8,043,140 | B2 | 10/2011 | Fujita | |
| 8,047,899 | B2 | 11/2011 | Chen et al. | |
| 8,062,096 | B2 | 11/2011 | Brusic et al. | |
| 8,071,479 | B2 | 12/2011 | Liu | |
| 8,088,299 | B2 | 1/2012 | Chen et al. | |
| 8,101,060 | B2 | 1/2012 | Lee | |
| 8,101,093 | B2 | 1/2012 | De Rege et al. | |
| 2001/0009843 | A1* | 7/2001 | Hirokawa et al. | 451/160 |
| 2001/0011003 | A1* | 8/2001 | Numoto | 451/379 |
| 2001/0034199 | A1* | 10/2001 | Park | 451/287 |
| 2001/0041522 | A1* | 11/2001 | Shendon et al. | 451/288 |
| 2001/0044268 | A1* | 11/2001 | Shendon | 451/285 |
| 2002/0009958 | A1* | 1/2002 | Gotcher | 451/288 |
| 2002/0033230 | A1* | 3/2002 | Hayashi et al. | 156/345 |
| 2002/0173256 | A1* | 11/2002 | Suwabe | 451/287 |
| 2002/0182995 | A1* | 12/2002 | Shendon et al. | 451/398 |
| 2003/0008600 | A1* | 1/2003 | Ide | 451/41 |
| 2003/0008604 | A1* | 1/2003 | Boo et al. | 451/388 |
| 2003/0129932 | A1* | 7/2003 | Ficarro | 451/288 |
| 2005/0118939 | A1 | 6/2005 | Duescher | |
| 2007/0111641 | A1* | 5/2007 | Lee et al. | 451/11 |
| 2008/0299875 | A1 | 12/2008 | Duescher | |
| 2010/0003904 | A1 | 1/2010 | Duescher | |
| 2011/0223835 | A1 | 9/2011 | Duescher | |
| 2011/0223836 | A1 | 9/2011 | Duescher | |
| 2011/0223838 | A1 | 9/2011 | Duescher | |

OTHER PUBLICATIONS

Wayne O. Duescher, Three-point fixed-spindle floating-platen abrasive system, U.S. Appl. No. 12/799,841, filed May 3, 2010. Earliest Publication No. US 20110223836 A1 Earliest Publication Date: Sep. 15, 2011.

Wayne O. Duescher, Fixed-spindle and floating-platen abrasive system using spherical mounts , U.S. Appl. No. 12/807,802, filed Sep. 14, 2010. Earliest Publication No. US 20110223838 A1 Earliest Publication Date: Sep. 15, 2011.

* cited by examiner

BELLOWS DRIVEN AIR FLOATATION ABRADING WORKHOLDER

BACKGROUND OF THE INVENTION

Field of the Invention

The present invention relates to the field of abrasive treatment of surfaces such as grinding, polishing and lapping. In particular, the present invention relates to a high speed bellow-drive semiconductor wafer workholder system for use with single-sided abrading machines that have rotary abrasive coated flat-surfaced platens. The bellows-drive workholders allow the workpiece substrates to be rotated at the same high rotation speeds as the platens. Often these platen and workholder speeds exceed 3,000 rpm. Conventional workholders can only attain these required rotational speeds with the use of complex devices and operational procedures.

The flexible bellows driven workholders provide that uniform abrading pressures are applied across the full abraded surfaces of the workpieces such as semiconductor wafers. One or more of the workholders can be used simultaneously with a rotary abrading platen.

High speed flat lapping is typically performed using flexible disks that have an annular band of abrasive-coated raised islands. These raised-island disks are attached to flat-surfaced platens that rotate at high abrading speeds. The use of the raised island disks prevent hydroplaning of the lapped workpieces when they are lapped at high speeds with the presence of coolant water. Hydroplaning causes the workpieces to tilt which results in non-flat lapped workpiece surfaces. Excess water is routed from contact with the workpiece flat surfaces into the recessed passageways that surround the abrasive coated raised island structures.

Flat lapping of workpiece surfaces used to produce precision-flat and mirror smooth polished surfaces is required for many high-value parts such as semiconductor wafer and rotary seals. The accuracy of the lapping or abrading process is constantly increased as the workpiece performance, or process requirements, become more demanding. Workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance.

The chemical mechanical planarization (CMP) liquid-slurry abrading system has been the system-of-choice for polishing semiconductor wafers that are already exceedingly flat. During CMP polishing, a very small amount of material is removed from the surface of the wafer. Typically the amount of material removed by polishing is measured in angstroms where the overall global flatness of the wafer is not affected much. It is critical that the global flatness of the wafer surface is maintained in a precision-flat condition to allow new patterned layers of metals and insulating oxides to be deposited on the wafer surfaces with the use of photolithography techniques. Global flatness is a measure of the flatness across the full surface of the wafer. Site or localized flatness of a wafer refers to the flatness of a localized portion of the wafer surface.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800, commonly assigned U.S. patent application published numbers 20100003904; 20080299875 and 20050118939 and U.S. patent application Ser. Nos. 12/661,212, 12/799,841 and 12/807,802 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

U.S. Pat. No. 6,769,969 (Duescher) describes flexible abrasive disks that have annular bands of abrasive coated raised islands. These disks use fixed-abrasive particles for high speed flat lapping as compared with other lapping systems that use loose-abrasive liquid slurries. The flexible raised island abrasive disks are attached to the surface of a rotary platen to abrasively lap the surfaces of workpieces.

Various abrading machines and abrading processes are described in U.S. Pat. No. 5,364,655 (Nakamura et al). U.S. Pat. No. 5,569,062 (Karlsrud), U.S. Pat. No. 5,643,067 (Katsuoka et al), U.S. Pat. No. 5,769,697 (Nisho), U.S. Pat. No. 5,800,254 (Motley et al), U.S. Pat. No. 5,916,009 (Izumi et al), U.S. Pat. No. 5,964,651 (hose), U.S. Pat. No. 5,975,997 (Minami, U.S. Pat. No. 5,989,104 (Kim et al), U.S. Pat. No. 6,089,959 (Nagahashi, U.S. Pat. No. 6,165,056 (Hayashi et al), U.S. Pat. No. 6,168,506 (McJunken), U.S. Pat. No. 6,217,433 (Herrman et al), U.S. Pat. No. 6,439,965 (Ichino), U.S. Pat. No. 6,893,332 (Castor), U.S. Pat. No. 6,896,584 (Perlov et al), U.S. Pat. No. 6,899,603 (Homma et al), U.S. Pat. No. 6,935,013 (Markevitch et al), U.S. Pat. No. 7,001,251 (Doan et al), U.S. Pat. No. 7,008,303 (White et al), U.S. Pat. No. 7,014,535 (Custer et al), U.S. Pat. No. 7,029,380 (Horiguchi et al), U.S. Pat. No. 7,033,251 (Elledge), U.S. Pat. No. 7,044,838 (Maloney et al), U.S. Pat. No. 7,125,313 (Zelenski et al), U.S. Pat. No. 7,144,304 (Moore), U.S. Pat. No. 7,147,541 (Nagayama et al), U.S. Pat. No. 7,166,016 (Chen), U.S. Pat. No. 7,250,368 (Kida et al), U.S. Pat. No. 7,367,867 (Boller), U.S. Pat. No. 7,393,790 (Britt et al), U.S. Pat. No. 7,422,634 (Powell et al), U.S. Pat. No. 7,446,018 (Brogan et al), U.S.

Pat. No. 7,456,106 (Koyata et al), U.S. Pat. No. 7,470,169 (Taniguchi et al), U.S. Pat. No. 7,491,342 (Kamiyama et al), U.S. Pat. No. 7,507,148 (Kitahashi et al), U.S. Pat. No. 7,527,722 (Sharan) and U.S. Pat. No. 7,582,221 (Netsu et al).

Also, various CMP machines, resilient pads, materials and processes are described in U.S. Pat. No. 8,101,093 (de Rege Thesauro et al.), U.S. Pat. No. 8,101,060 (Lee), U.S. Pat. No. 8,071,479 (Liu), U.S. Pat. No. 8,062,096 (Brusic et al.), U.S. Pat. No. 8,047,899 (Chen et al.), U.S. Pat. No. 8,043,140 (Fujita), U.S. Pat. No. 8,025,813 (Liu et al.), U.S. Pat. No. 8,002,860 (Koyama et al.), U.S. Pat. No. 7,972,396 (Feng et al.), U.S. Pat. No. 7,955,964 (Wu et al.), U.S. Pat. No. 7,922,783 (Sakurai et al.), U.S. Pat. No. 7,897,250 (Iwase et al.), U.S. Pat. No. 7,884,020 (Hirabayashi et al.), U.S. Pat. No. 7,840,305 (Behr et al.), U.S. Pat. No. 7,838,482 (Fukasawa et al.), U.S. Pat. No. 7,837,800 (Fukasawa et al.), U.S. Pat. No. 7,833,907 (Anderson et al.), U.S. Pat. No. 7,822,500 (Kobayashi et al.), U.S. Pat. No. 7,807,252 (Hendron et al.), U.S. Pat. No. 7,762,870 (Ono et al.), U.S. Pat. No. 7,754,611 (Chen et al.), U.S. Pat. No. 7,753,761 (Fujita), U.S. Pat. No. 7,741,656 (Nakayama et al.), U.S. Pat. No. 7,731,568 (Shimomura et al.), U.S. Pat. No. 7,708,621 (Saito), U.S. Pat. No. 7,699,684 (Prasad), U.S. Pat. No. 7,648,410 (Choi), U.S. Pat. No. 7,618,529 (Ameen et al.), U.S. Pat. No. 7,579,071 (Huh et al.), U.S. Pat. No. 7,572,172 (Aoyama et al.), U.S. Pat. No. 7,568,970 (Wang), U.S. Pat. No. 7,553,214 (Menk et al.), U.S. Pat. No. 7,520,798 (Muldowney), U.S. Pat. No. 7,510,974 (Li et al.), U.S. Pat. No. 7,491,116 (Sung), U.S. Pat. No. 7,488,236 (Shimomura et al.), U.S. Pat. No. 7,488,240 (Saito), U.S. Pat. No. 7,488,235 (Park et al.), U.S. Pat. No. 7,485,241 (Schroeder et al.), U.S. Pat. No. 7,485,028 (Wilkinson et al), U.S. Pat. No. 7,456,107 (Keleher et al.), U.S. Pat. No. 7,452,817 (Yoon et al.), U.S. Pat. No. 7,445,847 (Kulp), U.S. Pat. No. 7,419,910 (Minamihaba et al.), U.S. Pat. No. 7,018,906 (Chen et al.), U.S. Pat. No. 6,899,609 (Hong), U.S. Pat. No. 6,729,944 (Birang et al.), U.S. Pat. No. 6,672,949 (Chopra et al.), U.S. Pat. No. 6,585,567 (Black et al.), U.S. Pat. No. 6,270,392 (Hayashi et al.), U.S. Pat. No. 6,165,056 (Hayashi et al.), U.S. Pat. No. 6,116,993 (Tanaka), U.S. Pat. No. 6,074,277 (Arai), U.S. Pat. No. 6,027,398 (Numoto et al.), U.S. Pat. No. 5,985,093 (Chen), U.S. Pat. No. 5,944,583 (Cruz et al.), U.S. Pat. No. 5,874,318 (Baker et al.), U.S. Pat. No. 5,683,289 (Hempel Jr.), U.S. Pat. No. 5,643,053 (Shendon),), U.S. Pat. No. 5,597,346 (Hempel Jr.).

Other wafer carrier heads are described in U.S. Pat. No. 5,421,768 (Fujiwara et al.), U.S. Pat. No. 5,443,416 (Volodarsky et al.), U.S. Pat. No. 5,738,574 (Tolles et al.), U.S. Pat. No. 5,993,302 (Chen et al.), U.S. Pat. No. 6,050,882 (Chen), U.S. Pat. No. 6,056,632 (Mitchel et al.), U.S. Pat. No. 6,080,050 (Chen et al.), U.S. Pat. No. 6,126,116 (Zuniga et al.), U.S. Pat. No. 6,132,298 (Zuniga et al.), U.S. Pat. No. 6,146,259 (Zuniga et al.), U.S. Pat. No. 6,179,956 (Nagahara et al.), U.S. Pat. No. 6,183,354 (Zuniga et al.), U.S. Pat. No. 6,251,215 (Zuniga et al.), U.S. Pat. No. 6,299,741 (Sun et al.), U.S. Pat. No. 6,361,420 (Zuniga et al.), U.S. Pat. No. 6,390,901 (Hiyama et al.), U.S. Pat. No. 6,390,905 (Korovin et al.), U.S. Pat. No. 6,394,882 (Chen), U.S. Pat. No. 6,436,828 (Chen et al.), U.S. Pat. No. 6,443,821 (Kimura et al.), U.S. Pat. No. 6,447,368 (Fruitman et al.), U.S. Pat. No. 6,491,570 (Sommer et al.), U.S. Pat. No. 6,506,105 (Kajiwara et al.), U.S. Pat. No. 6,558,232 (Kajiwara et al.), U.S. Pat. No. 6,592,434 (Vanell et al.), U.S. Pat. No. 6,659,850 (Korovin et al.), U.S. Pat. No. 6,837,779 (Smith et al.), U.S. Pat. No. 6,899,607 (Brown), U.S. Pat. No. 7,001,257 (Chen et al.), U.S. Pat. No. 7,081,042 (Chen et al.), U.S. Pat. No. 7,101,273 (Tseng et al.), U.S. Pat. No. 7,292,427 (Murdock et al.), U.S. Pat. No. 7,527,271 (Oh et al.), U.S. Pat. No. 7,601,050 (Zuniga et al.), U.S. Pat. No. 7,883,397 (Zuniga et al.), U.S. Pat. No. 7,947,190 (Brown), U.S. Pat. No. 7,950,985 (Zuniga et al.), U.S. Pat. No. 8,021,215 (Zuniga et al.), U.S. Pat. No. 8,029,640 (Zuniga et al.), U.S. Pat. No. 8,088,299 (Chen et al.), All references cited herein are incorporated herein in the entirety by reference.

SUMMARY OF THE INVENTION

The presently disclosed technology includes precision-thickness flexible abrasive disks having disk thickness variations of less than 0.0001 inches (3 microns) across the full annular bands of abrasive-coated raised islands to allow flat-surfaced contact with workpieces at very high abrading speeds. Use of a platen vacuum disk attachment system allows quick set-up changes where different sizes of abrasive particles and different types of abrasive material can be quickly attached to the flat platen surfaces.

Water coolant is used with these raised island abrasive disks, which allows them to be used at very high abrading speeds, often in excess of 10,000 SFPM (160 km per minute). The coolant water is typically applied directly to the top surfaces of the workpieces. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading and with continuous-coated abrasive disks.

Semiconductor wafers require extremely flat surfaces when using photolithography to deposit patterns of materials to form circuits across the full flat surface of a wafer. When theses wafers are abrasively polished between deposition steps, the surfaces of the wafers must remain precisely flat.

Resilient wafer pads can be used to minimize the effects of the abraded surfaces of the wafers not being precisely parallel to the platen abrading surface. When the platen is lowered into abrading contact with the workpieces, the resilient pads are compressed and the wafer assumes full flat-surfaced contact with the platen abrading surface. The wafers are then abraded uniformly across the full abraded surfaces of the wafers.

The same types of chemicals that are used in the conventional CMP polishing of wafers can be used with this abrasive lapping or polishing system. These liquid chemicals can be applied as a mixture with the coolant water that is used to cool both the wafers and the fixed abrasive coatings on the rotating abrading platen This mixture of coolant water and chemicals continually washes the abrading debris away from the abrading surfaces of the fixed-abrasive coated raised islands which prevents unwanted abrading contact of the abrasive debris with the abraded surfaces of the wafers.

The air bearing workholders can be used with a wide variety of abrasive media. The rotary platens can be covered with flexible abrasive-coated raised island disks or the platens can be coated with a slurry mixture of abrasive particles and a liquid. In addition, these workholders can be used to provide CMP polishing of semiconductor wafers at abrading speeds that are substantially increased over the abrading speeds of conventional CMP polishing machines.

Slurry lapping is often done at very slow abrading speeds of about 5 mph (8 kph). By comparison, the high speed flat lapping system often operates at or above 100 mph (160 kph). This is a speed difference ratio of 20 to 1. These abrading speeds can exceed 10,000 surface feet per minute (SFPM) or 3,048 surface meters per minute. Increasing abrading speeds increase the material removal rates. High abrading speeds result in high workpiece production rates and large cost savings.

Workpieces are often rotated at rotational speeds that are approximately equal to the rotational speeds of the platens to provide equally-localized abrading speeds across the full radial width of the platen annular abrasive when the workpiece spindles are rotated in the same rotation direction as the platens. Often these platen and workholder rotational speeds exceed 3,000 rpm. Typically, conventional spherical action types of workholders are used to provide flat-surfaced contact of workpieces with a flat-surfaced abrasive covered platen that rotates at very high speeds. In addition, the abrading friction forces that are applied to the workpieces by the moving abrasive tend to tilt the workpieces that are attached to the offset workholders. Tilting causes non-flat abraded workpiece surfaces.

Also, these conventional rotating offset spherical-action workholders are nominally unstable at very high rotation speeds, especially when the workpieces are not held firmly in direct flat-surfaced contact with the platen abrading surface. It is necessary to provide controlled operation of these unstable spherical-action workholders to prevent unwanted vibration or oscillation of the workholders (and workpieces) at very high rotational speeds of the workholders. Vibrations of the workholders can produce patterns of uneven surface wear of an expensive semiconductor wafer.

The present system provides friction-free and vibrationally stable rotation of the workpieces without the use of offset spherical-action universal joint rotation devices. Tilting of the workpieces dos not occur because the offset spherical-action universal joint rotation devices are not used. Uniform abrading pressures are applied across the full abraded surfaces of the workpieces such as semiconductor wafers by the air bearing workholders. Also, one or more of the workholders can be used simultaneously with a rotary abrading platen.

DETAILED DESCRIPTION OF THE INVENTION

Figure 13:
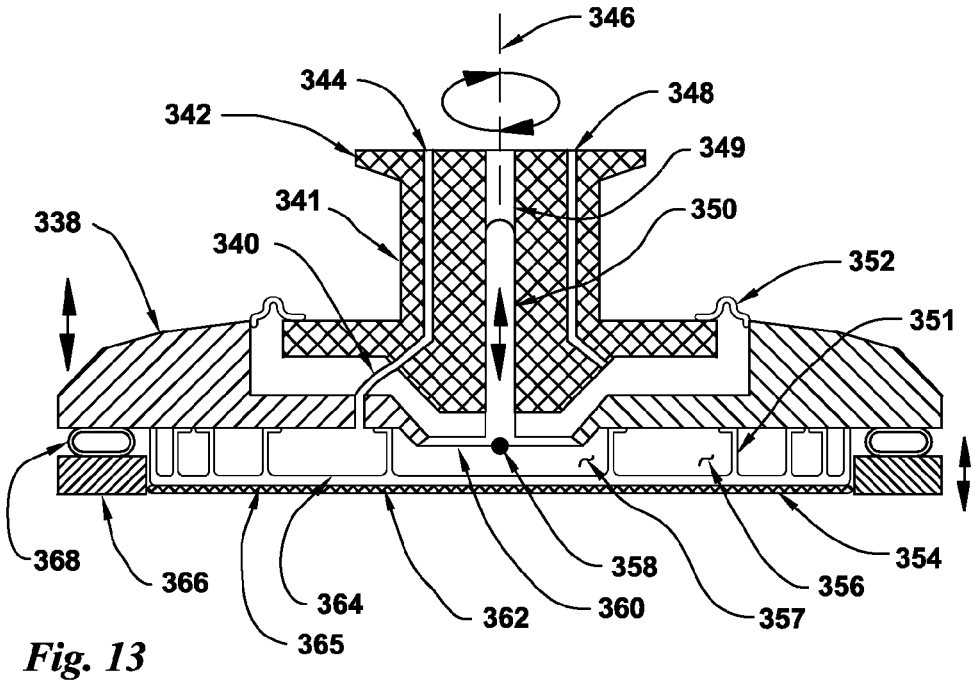
Fig. 13 Prior Art
FIG. 13 is a cross section view of a prior art pneumatic bladder type of wafer carrier.

FIG. 13 is a cross section view of a conventional prior art pneumatic bladder type of wafer carrier. A rotatable wafer carrier head 341 having a wafer carrier hub 342 is attached to the rotatable head (not shown) of a polishing machine tool (not shown) where the carrier hub 342 is loosely attached with flexible joint device 352 and a rigid slide-pin 350 to a rigid carrier plate 338. The cylindrical rigid slide-pin 350 can move along a cylindrical hole 349 in the carrier hub 342 which allows the rigid carrier plate 338 to move axially along the hole 349 where the movement of the carrier plate 338 is relative to the carrier hub 342. The rigid slide-pin 350 is attached to a flexible diaphragm 360 that is attached to carrier plate 338 which allows the carrier plate 338 to be spherically rotated about a rotation point 358 relative to the rotatable carrier hub 342 that is remains aligned with its rotational axis 346.

A sealed flexible elastomeric diaphragm device 364 has a number of individual annular sealed pressure chambers 356 having flexible elastomeric chamber walls 351 and a circular center chamber 357 where the air pressure can be independently adjusted for each of the individual chambers 356, 357 to provide different abrading pressures to a wafer workpiece 354 that is attached to the wafer mounting surface 365 of the elastomeric diaphragm 364. A wafer 354 carrier annular back-up ring 366 provides containment of the wafer 354 within the rotating but stationary-positioned wafer carrier head 341 as the wafer 354 abraded surface 362 is subjected to abrasion-friction forces by the moving abrasive coated platen (not shown). An air-pressure annular bladder 368 applies controlled contact pressure of the wafer 354 carrier annular back-up ring 366 with the platen abrasive coating surface. Controlled-pressure air is supplied from air inlet passageways 344 and 396 in the carrier hub 342 to each of the multiple flexible pressure chambers 356, 357 by flexible tubes 340.

When CMP polishing of wafers takes place, a resilient porous CMP pad is saturated with a liquid loose-abrasive slurry mixture and is held in moving contact with the flat-surfaced semiconductor wafers to remove a small amount of excess deposited material from the top surface of the wafers. The wafers are held by a wafer carrier head that rotates as the wafer is held in abrading contact with the CMP pad that is attached to a rotating rigid platen. Both the carrier head and the pad are rotated at the same slow speeds.

The pneumatic-chamber wafer carrier heads typically are constructed with a flexible elastomer membrane that supports a wafer where five individual annular chambers allow the abrading pressure to be varied across the radial surface of the wafer. The rotating carrier head has a rigid hub and a floating wafer carrier plate that has a "spherical" center of rotation where the wafer is held in flat-surfaced abrading contact with a moving resilient CMP pad. A rigid wafer retaining ring that contacts the edge of the wafer is used to resist the abrading forces applied to the wafer by the moving pad.

Figure 14:
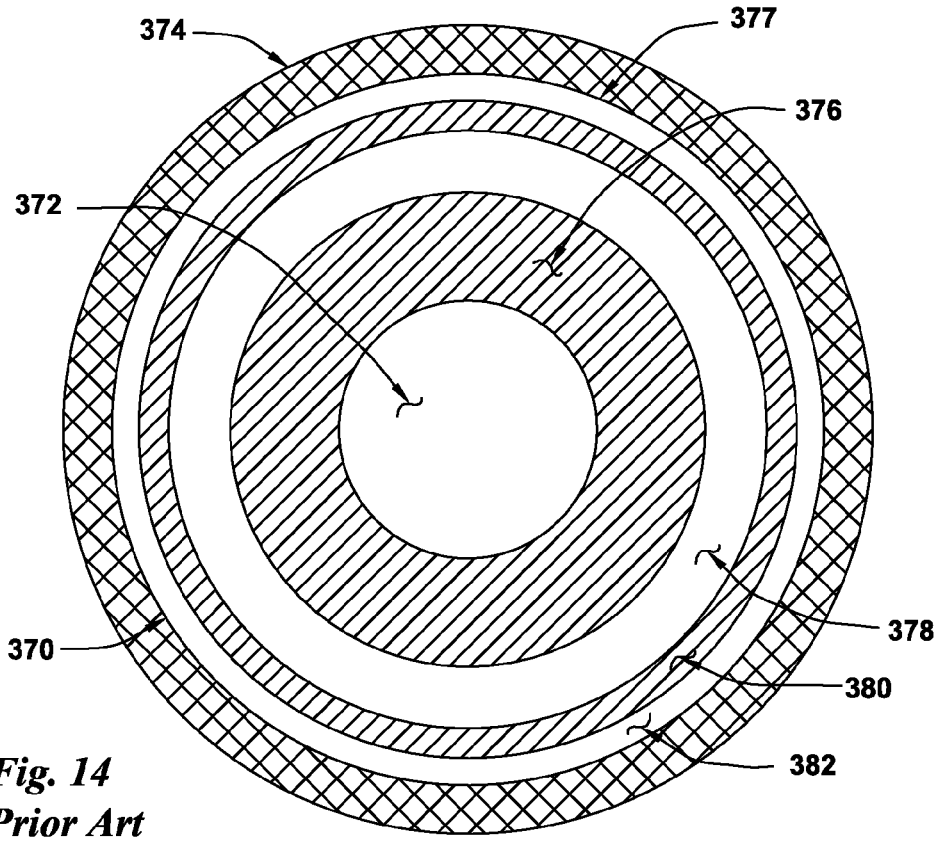
Fig. 14 Prior Art
FIG. 14 is a bottom view of a prior art pneumatic bladder type of wafer carrier.

FIG. 14 is a bottom view of a conventional prior art pneumatic bladder type of wafer carrier. A wafer carrier head 374 having an continuous nominally-flat surface elastomeric diaphragm 377 is shown having multiple annular pneumatic pressure chamber areas 376, 378, 380, 382 and one circular center pressure chamber area 372. The wafer carrier head 374 can have more or less than five individual pressure chambers. A wafer carrier head 374 annular back-up ring 370 provides containment of the wafer (not shown) within the wafer carrier head 374 as the wafer (not shown) that is attached to the continuous nominally-flat surface of the elastomeric diaphragm device 377 is subjected to abrasive friction forces. Here, the semiconductor wafer substrate is loosely attached to a flexible continuous-surface of a membrane that is attached to the rigid portion of the substrate carrier. Multiple pneumatic air-pressure chambers that exist between the substrate mounting surface of the membrane and the rigid portion of the substrate carrier are an integral part of the carrier membrane.

Each of the five annular pneumatic chambers shown here can be individually pressurized to provide different abrading pressures to different annular portions of the wafer substrate. These different localized abrading pressures are provided to compensate for the non-uniform abrading action that occurs with this wafer polishing system.

The flexible semiconductor wafer is extremely flat on both opposed surfaces. Attachment of the wafer to the carrier membrane is accomplished by pushing the very flexible membrane against the flat backside surface of a water-wetted wafer to drive out all of the air and excess water that exists between the wafer and the membrane. The absence of an air film in this wafer-surface contact are provides an effective suction-attachment of the wafer to the carrier membrane surface. Sometimes localized "vacuum pockets" are used to enhance the attachment of the wafer to the flexible flat-surfaced membrane.

Each of the five annular pressure chambers expand vertically when pressurized. The bottom surfaces of each of these chambers move independently from their adjacent annular chambers. By having different pressures in each annular ring-chamber, the individual chamber bottom surfaces are not in a common plane if the wafer is not held in flat-surfaced abrading contact with a rigid abrasive surface. If the abrasive surface is rigid, then the bottom surfaces of all of the five annular rings will be in a common plane. However, when the abrasive surface is supported by a resilient pad, each individual pressure chamber will distort the abraded wafer where the full wafer surface is not in a common plane. Resilient support pads are used both for CMP pad polishing and for fixed-abrasive web polishing.

Because of the basic design of the flexible membrane wafer carrier head that has five annular zones, each annular abrading pressure-controlled zone provides an "average" pressure for that annular segment. This constant or average pressure that exist across the radial width of that annular pressure chamber does not accurately compensate for the non-linear wear rate that actually occurs across the radial width of that annular band area of the wafer surface.

Overall, this flexible membrane wafer substrate carrier head is relatively effective for CMP pad polishing of wafers. Use of it with resilient CMP pads require that the whole system be operated at very low speeds, typically at 30 rpm. However, the use of this carrier head also causes many problems results in non-uniform material removal across the full surface of a wafer.

Figure 15:
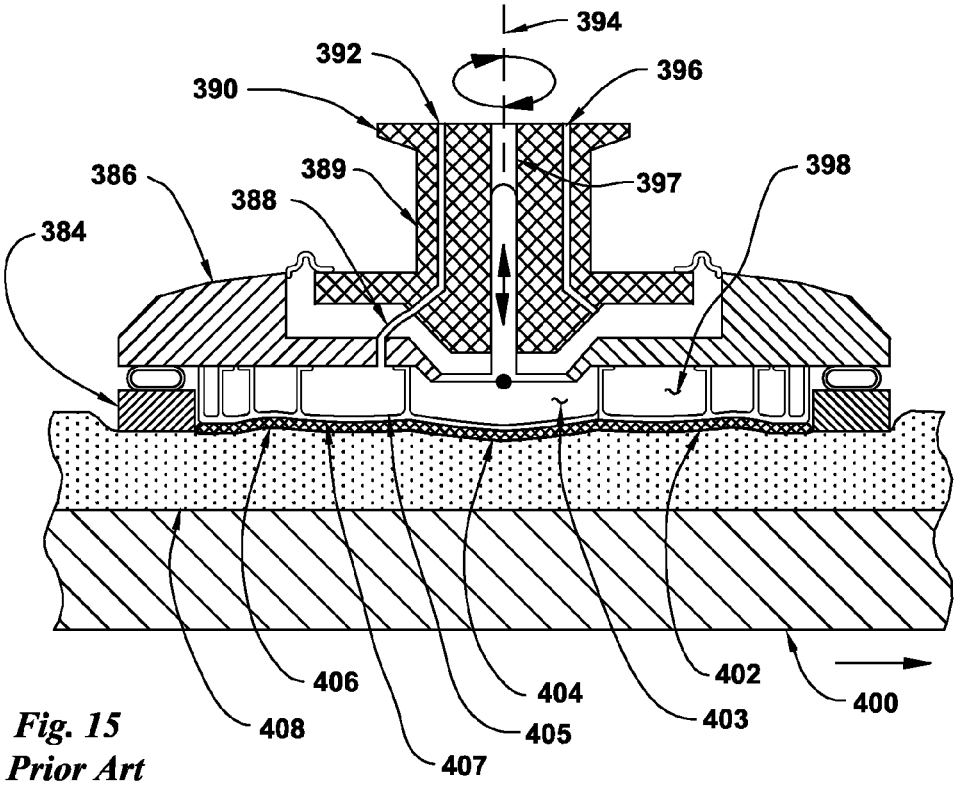
Fig. 15 Prior Art
FIG. 15 is a cross section view of a prior art bladder wafer carrier with a distorted bottom.

FIG. 15 is a cross section view of a prior art pneumatic bladder type of wafer carrier with a distorted bottom surface. A rotatable wafer carrier head 389 having a wafer carrier hub 390 is attached to the rotatable head (not shown) of a wafer polishing machine tool (not shown) where the carrier hub 390 is loosely attached with flexible joint devices and a rigid slide-pin to a rigid carrier plate 386. The cylindrical rigid slide-pin can move along a cylindrical hole 397 in the carrier hub 390 which allows the rigid carrier plate 386 to move axially along the hole 397 where the movement of the carrier plate 386 is relative to the carrier hub 390. The rigid slide-pin is attached to a flexible diaphragm that is attached to carrier plate 386 which allows the carrier plate 386 to be spherically rotated about a rotation point relative to the rotatable carrier hub 390 that is remains aligned with its rotational axis 394.

A sealed flexible elastomeric diaphragm device 405 having a nominally-flat but flexible wafer 402 mounting surface 407 has a number of individual annular sealed pressure chambers 398 and a circular center chamber 403 where the air pressure can be independently adjusted for each of the individual chambers 398, 403 to provide different abrading pressures to a wafer workpiece 402 that is attached to the wafer mounting surface 407 of the elastomeric diaphragm 405. A wafer 402 carrier annular back-up ring 384 provides containment of the wafer 402 within the rotating but stationary-positioned wafer carrier head 389 as the wafer 402 abraded surface 406 is subjected to abrasion-friction forces by the moving abrasive coated platen (not shown). An air-pressure annular bladder applies controlled contact pressure of the wafer 402 carrier annular back-up ring 384 with the platen abrasive coating surface. Controlled-pressure air is supplied from air inlet passageways 392 and 396 in the carrier hub 390 to each of the multiple flexible pressure chambers 398, 403 by flexible tubes 388.

When air, or other fluids such as water, pressures are applied to the individual sealed pressure chambers 398, 403, the flexible bottom wafer mounting surface 407 of the elastomeric diaphragm 405 is deflected different amounts in the individual annular or circular bottom areas of the sealed pressure chambers 398, 403 where the nominally-flat but flexible wafer 402 is distorted into a non-flat condition as shown by 404 as the wafer 402 is pushed downward into the flexible and resilient CMP pad 408 which is supported by a rigid rotatable platen 400.

When the multi-zone wafer carrier is used to polish wafer surfaces with a resilient CMP abrasive slurry saturated polishing pad, the individual annular rings push different annular portions of the wafer into the resilient pad. Each of the wafer carrier air-pressure chambers exerts a different pressure on the wafer to provide uniform material removal across the full surface of the wafer. Typically the circular center of the wafer carrier flexible diaphragm has the highest pressure. This high-pressure center-area distorts the whole thickness of the wafer as it is forced deeper into the resilient CMP wafer pad. Adjacent annular pressure zones independently distort other portions of the wafer.

Here, the wafer body is substantially distorted out-of-plane by the independent annual pressure chambers. However, the elastomer membrane that is used to attach the wafer to the rotating wafer carrier is flexible enough to allow the individual pressure chambers to flex the wafer while still maintaining the attachment of the wafer to the membrane. As the wafer body is distorted, the distorted and moving resilient CMP pad is thick enough to allow this out-of-plane distortion to take place while providing polishing action on the wafer surface.

When a wafer carrier pressure chamber is expanded downward, the chamber flexible wall pushes a portion of the wafer down into the depths of the resilient CMP pad. The resilient CMP pad is compressible and acts as an equivalent series of compression springs. The more that a spring is compressed, the higher the resultant force is. The compression of a spring is defined as F=KX where F is the spring force, K is the spring constant and X is the distance that the end of the spring is deflected.

The CMP resilient pads have a stiffness that resists wafers being forced into the depths of the pads. Each pad has a spring constant that is typically linear. In order to develop a higher abrading pressure at a localized region of the flat surface of a wafer, it is necessary to move that portion of the wafer down into the depth of the compressible CMP pad. The more that the wafer is moved downward to compresses the pad, the higher the resultant abrading force in that localized area of the wafer. If the spring-like pad is not compressed, the required wafer abrading forces are not developed.

Due to non-uniform localized abrading speeds on the wafer surface, and other causes such as distorted resilient pads, it is necessary to compress the CMP pad different amounts at different radial areas of the wafer. However, the multi-zone pressure chamber wafer carrier head has abrupt chamber-bottom membrane deflection discontinuities at the annular joints that exist between adjacent chambers having different chamber pressures. Undesirable wafer abrading pressure discontinuities exist at these membrane deflection discontinuity annular ring-like areas.

Often, wafers that are polished using the pneumatic wafer carrier heads are bowed. These bowed wafers can be attached to the flexible elastomeric membranes of the carrier heads. However, in a free-state, these bowed wafers will be first attached to the center-portion of the carrier head. Here, the outer periphery of the bowed wafer contacts the CMP pad surface before the wafer center does. Pressing the wafer into forced contact with the CMP pad allows more of the wafer surface to be in abrading contact with the pad. Using higher fluid pressures in the circular center of the carrier head chamber forces this center portion of the bowed wafer into the pad to allow uniform abrading and material removal across this center portion of the surface of the wafer. There is no defined planar reference surface for abrading the surface of the wafer.

Figure 16:
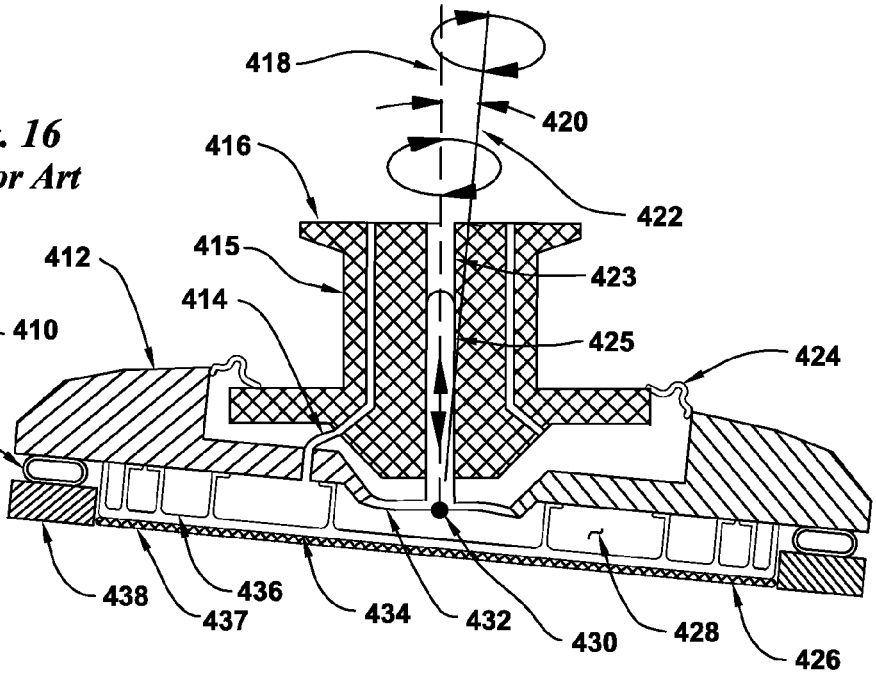
Fig. 16 Prior Art
FIG. 16 is a cross section view of a prior art bladder type of wafer carrier with a tilted wafer.

FIG. 16 is a cross section view of a prior art pneumatic bladder type of wafer carrier head with a tilted wafer carrier. The pneumatic-chamber carrier head is made up of two internal parts to allow "spherical-action" motion of the floating annular plate type of substrate carrier that is supported by a rotating carrier hub. The floating substrate carrier plate is attached to the rotating drive hub by a flexible elastomeric or a flexible metal diaphragm at the top portion of the hub. This upper elastomeric diaphragm allows approximate-spherical motion of the substrate carrier to provide flat-surfaced contact of the wafer substrate with the "flat" but indented resilient CMP pad. The CM pad is saturated with a liquid abrasive slurry mixture.

To keep the substrate nominally centered with the rotating carrier drive hub, a stiff (or flexible) post is attached to a flexible annular portion of the rigid substrate carrier structure. This circular centering-post fits in a cylindrical sliding-bearing receptacle-tube that is attached to the rotatable hub along the hub rotation axis. When misalignment of the polishing tool (machine) components occurs or large lateral friction abrading forces tilt the carrier head, the flexible centering post tends to slide vertically along the length of the carrier head rotation axis. This post-sliding action and out-of-plane distortion of the annular diaphragm that is attached to the base of the centering posts together provide the required "spherical-action" motion of the rigid carrier plate. In this way, the surface of the wafer substrate is held in flat-surfaced contact with the nominal-flatness of the CMP pad as the carrier head rotates.

Here, the "spherical action" motion of the substrate carrier depends upon the localized distortion of the structural member of the carrier head. This includes diaphragm-bending of the flexible annular base portion of the rigid substrate carrier which the center-post shaft is attached to. All of these carrier head components are continuously flexed upon each rotation of the carrier head which often requires that the wafer substrate carrier head is typically operated at very slow operating speeds of only 30 rpm.

A rotatable wafer carrier head 415 having a wafer carrier hub 416 is attached to the rotatable head (not shown) of a polishing machine tool (not shown) where the carrier hub 416 is loosely attached with flexible joint device 424 and a rigid slide-pin 425 to a rigid carrier plate 412. The cylindrical rigid slide-pin 425 can move along a cylindrical hole 423 in the carrier hub 416 which allows the rigid carrier plate 412 to move axially along the hole 423 where the movement of the carrier plate 412 is relative to the carrier hub 416. The rigid slide-pin 425 is attached to a flexible diaphragm 432 that is attached to the carrier plate 412 which allows the carrier plate 412 to be spherically rotated about a rotation point 430 relative to the rotatable carrier hub 416 that is remains aligned with its rotational axis 346.

The carrier plate 412 is shown spherically rotated about a rotation point 430 relative to the rotatable carrier hub 416 where the slide-pin axis 418 is at a tilt-angle 420 with an axis 422 that is perpendicular with the wafer 426 abraded surface 434 and where the carrier plate 412 and the wafer 426 are shown here to rotate about the axis 422. The flexible diaphragm 432 that is attached to the carrier plate 412 is distorted when the carrier plate 412 is spherically rotated about a rotation point 430 relative to the rotatable carrier hub 416.

A sealed flexible elastomeric diaphragm device 436 has a number of individual annular sealed pressure chambers 428 and a circular center chamber where the air pressure can be independently adjusted for each of the individual chambers 428 to provide different abrading pressures to a wafer workpiece 426 that is attached to the wafer mounting surface 437 of the elastomeric diaphragm 436. A wafer 426 carrier annular back-up ring 438 provides containment of the wafer 426 within the rotating but stationary-positioned wafer carrier head 415 as the wafer 426 abraded surface 434 is subjected to abrasion-friction forces by the moving abrasive coated platen (not shown). An air-pressure annular bladder 410 applies controlled contact pressure of the wafer 426 carrier annular back-up ring 438 with the platen abrasive coating surface. Controlled-pressure air is supplied from air inlet passageways in the carrier hub 416 to each of the multiple flexible pressure chambers 428 by flexible tubes 414.

The pneumatic abrading pressures that are applied during CMP polishing procedures range from 1 to 8 psi. The downward pressures that are applied by the wafer retaining ring to push-down the resilient CMP pad prior to it contacting the leading edge of the wafer are often much higher than the nominal abrading forces applied to the wafer. For a 300 mm (12 inch) diameter semiconductor wafer substrate, that has a surface area of 113 sq. inches, an abrading force of 4 psi is often applied for polishing with a resilient CMP pad. The resultant downward abrading force on the wafer substrate is 4×113=452 lbs. An abrading force of 2 psi results in a downward force of 226 lbs.

The coefficient of friction between a resilient pad and a wafer substrate can vary between 0.5 and 2.0. Here, the wafer is plunged into the depths of the resilient CMP pad. A lateral force is applied to the wafer substrate along the wafer flat surface that is a multiple of the coefficient of friction and the applied downward abrading force. If the downward force is 452 lbs and the coefficient of friction is 0.5, then the lateral force is 226 lbs. If the downward force is 452 lbs and the coefficient of friction is 2.0, then the lateral force is 904 lbs. If a 2 psi downward force is 226 lbs and the coefficient of friction is 2.0, then the lateral force is 452 lbs.

When this lateral force of 226 to 904 lbs is applied to the wafer, it tends to drive the wafer against the rigid outer wafer retaining ring of the wafer carrier head. Great care is taken not to damage or chip the fragile, very thin and expensive semiconductor wafer due to this wafer-edge contact. This wafer edge-contact position changes continually along the periphery of the wafer during every revolution of the carrier head. Also, the overall structure of the carrier head is subjected to this same lateral force that can range from 226 to 904 lbs.

All the head internal components tend to tilt and distort when the head is subjected to the very large friction forces caused by forced-contact with the moving abrasive surface. The plastic components that the pneumatic head is constructed from have a stiffness that is a very small fraction of the stiffness of same-sized metal components. This is especially the case for the very flexible elastomeric diaphragm materials that are used to attach the wafers to the carrier head. These plastic and elastomeric components tend to bend and distort substantial amounts when they are subjected to these large lateral abrading friction forces.

The equivalent-vacuum attachment of a water-wetted wafer, plus the coefficient-of-friction surface characteristics of the elastomer membrane, are sufficient to successfully maintain the attachment of the wafer to the membrane even when the wafer is subjected to the large lateral friction-caused abrading forces. However, to maintain the attachment of the wafer to the membrane, it is necessary that the flexible elastomer membrane is distorted laterally by the friction forces to where the outer periphery edge of the wafer is shifted laterally to contact the wall of the rigid wafer substrate retainer ring. Because the thin wafer is constructed form a very rigid silicon material, it is very stiff in a direction along the flat surface of the wafer.

The rigid wafer outer periphery edge is continually pushed against the substrate retainer ring to resist the very large lateral abrading forces. This allows the wafer to remain attached to the flexible elastomer diaphragm flat surface because the very weak diaphragm flat surface is also pushed laterally by the abrading friction forces. Most of the lateral abrading friction forces are resisted by the body of the wafer and a small amount is resisted by the elastomer bladder-type diaphragm. Contact of the wafer edge with the retainer ring continually moves along the wafer periphery upon each revolution of the wafer carrier head.

Figure 17:
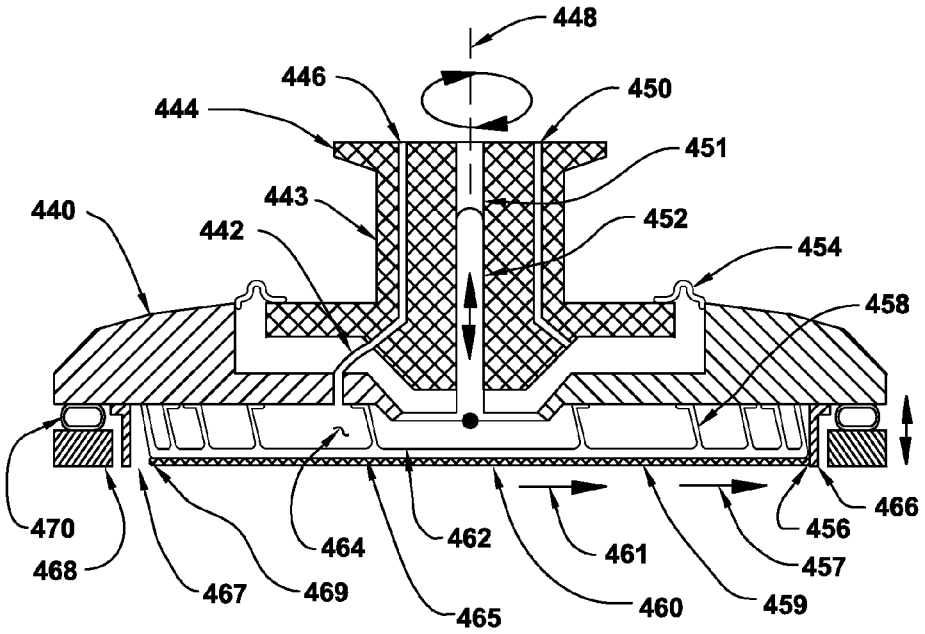
Fig. 17 Prior Art
FIG. 17 is a cross section view of a prior art bladder wafer carrier with a distorted bladder.

FIG. 17 is a cross section view of a conventional prior art pneumatic bladder type of wafer carrier where the bladder is distorted laterally by abrading friction forces. A rotatable wafer carrier head 443 having a wafer carrier hub 444 is attached to the rotatable head (not shown) of a polishing machine tool (not shown) where the carrier hub 444 is loosely attached with flexible joint device 454 and a rigid slide-pin 452 to a rigid carrier plate 440. The cylindrical rigid slide-pin 452 can move along a cylindrical hole in the carrier hub 444 which allows the rigid carrier plate 440 to move axially along the hole axis 448 which is also the rotational axis 448 of the carrier head 443 where the movement of the carrier plate 440 is relative to the carrier hub 444. The rigid slide-pin 452 is attached to a flexible diaphragm that is attached to carrier plate 440 which allows the carrier plate 440 to be spherically rotated about a rotation point relative to the rotatable carrier hub 444 that is remains aligned with its rotational axis 448.

A sealed flexible elastomeric diaphragm device 462 has a number of individual annular sealed pressure chambers 464 and a circular center chamber where the air pressure can be independently adjusted for each of the individual chambers 464 to provide different abrading pressures to a wafer workpiece 460 that is attached to the wafer mounting surface 465 of the elastomeric diaphragm 462. A wafer 460 carrier annular back-up ring 468 provides containment of the wafer 460 within the rotating but stationary-positioned wafer carrier head 443 as the wafer 460 abraded surface 459 is subjected to abrasion-friction forces 461 by the moving abrasive coated platen (not shown). An air-pressure annular bladder 470 applies controlled contact pressure of the wafer 460 carrier annular back-up ring 468 with the platen abrasive coating surface. Controlled-pressure air is supplied from air inlet passageways 446 and 450 in the carrier hub 444 to each of the multiple flexible pressure chambers 464 by flexible tubes 442.

The abrading friction forces 461 act on the wafer 460 abraded surface 459 in a direction 457 that the platen abrasive coating moves where the forces 461 act on the sealed flexible elastomeric diaphragm device 462 which translates the wafer mounting surface 465 of the elastomeric diaphragm 462 and the wafer 460 where the peripheral edge 469 of the wafer 460 is forced at a location 456 against the rigid wafer retaining ring 466 that is attached to the carrier plate 440. The flexible elastomeric chamber walls 458 of the sealed flexible elastomeric diaphragm device 462 are distorted from their non-force stressed original shapes that exist when the abrading forces 461 are not present. When the wafer 460 is moved into contact with the rigid wafer retaining ring 466 at a location 456, a corresponding gap 467 exists between the peripheral edge 456 of the wafer 460 and the rigid wafer retaining ring 466 in a location that is diagonally across the abraded surface 459 from the location 456 where the wafer 460 is in forced contact with the rigid wafer retaining ring 466. The forced contact of the wafer 460 moves along the peripheral edge 456 of the wafer 460 as the wafer 460 and the wafer carrier head 443 is rotated while the wafer 460 is in abrading contact with the rotating platen abrasive coating.

Semiconductor wafers that are fabricated are intentionally made quite thick during the deposition process to allow handling during CMP polishing procedures and for the sequential surface deposition steps. Often, 40 or 50 deposition layers are made to a wafer during the wafer fabrication process. Each deposition layer thickness can be a few angstroms thick but after 4 or 5 deposition steps it is necessary to polish the surface of the wafer to remove excess deposition materials and to re-establish the global flatness of the wafer surface. Use of the resilient CMP pads to perform this wafer polishing procedure is the most common method of polishing used. After all of the deposition and polishing steps have been completed, the wafer is backside-ground to reduce the overall thickness of the wafer and the individual semiconductor devices.

When a flat-surfaced vacuum-chuck workholder having an attached wafer is pressed down into the surface-depths of a resilient CMP pad, the pad surface is distorted in the area that is directly adjacent to the outer periphery of the wafer. Here, the moving resilient pad is compressed as it is held in abrading contact with the flat surfaced wafer. The compressed CMP pad assumes a flat profile where it contacts the central portion of the circular wafer. However, the localized portion of the moving resilient CMP pad that comes into contact with the outer periphery of the rotating wafer becomes distorted. This CMP pad distortion tends to produce undesirable above-average material removal at the wafer periphery. This uneven abrading action results in non-flat wafers.

Large diameter 300 mm (12 inch) wafers being polished typically have a thickness of 0.030 inches to provide enough strength and stiffness for handling in the semiconductor fabrication process. These wafers are repetitively subjected to polishing to remove excess metal and insulating materials that are deposited on the surfaces to form the semiconductor circuits. Because the silicon wafers are brittle, and the force-contact area continually moves around the circumference of the wafer as the wafer carrier head is rotated, the wafer edge tends to be chipped or cracked by the contact of the rigid wafer with the rigid or semi-rigid wafer retainer ring.

When the multi-chamber flexible substrate-mounting elastomer material membrane is subjected to the very large 200 to 400 lb lateral abrading forces, the whole flexible membrane tends to move laterally along the direction of the applied abrading forces. These abrading forces originate from the rotating CMP pad so they are always in the same direction relative to the rotating wafer and carrier head. These abrading forces tend to drive the whole flexible membrane to the "far" downstream side of the carrier head, away from the leading edge of the carrier head that faces upstream relative to the moving CMP pad.

However, as the pneumatic carrier head rotates, these applied lateral abrading forces contact a "new" portion of the wafer flexible membrane. Here, the membrane experiences a continuing radial excursion that occurs during each revolution of the carrier head. Localized distortions of portions of the substrate membrane occur particularly at the areas of the circular wafer substrate that is nominally restrained by the carrier rigid wafer retaining ring that is attached to the carrier head and surrounds the wafer substrate membrane.

Because the carrier head presses the wafer down into the surface-depths of the rotating resilient CMP pad, the moving pad tends to distort and crumple at the leading edge of the wafer. This pad distortion tends to cause extra-wear of the wafer at the outer periphery of the wafer flat surface. To compensate for this ripple-effect of the crumpled and moving pad, an independent rigid annular carrier ring is attached at the carrier head to locally press down the indented CMP pad just before it contacts the wafer periphery. Here, the localized pad-compression caused by the outer carrier ring is typically 1 psi greater than the abrading pressure that is applied to the wafer substrate. Typically the abrading pressure that is applied across the surface of the wafer is about 2 psi and sometimes ranges up to 8 psi. The applied pressure of the pad compression ring is 1, or even much more, psi greater than that of the typical nominal wafer surface abrading pressure.

Figure 18:
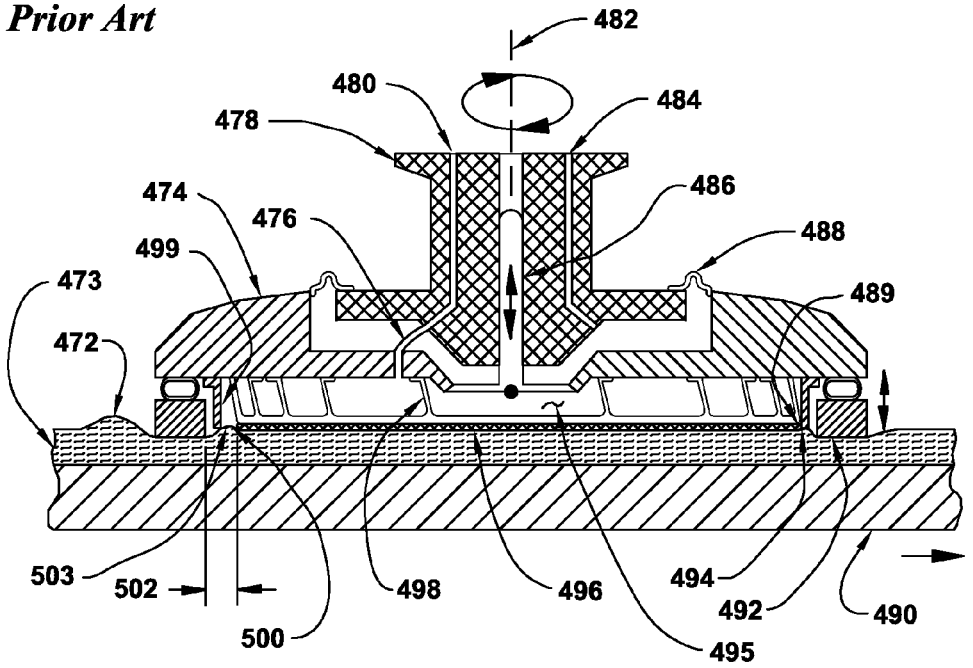
Fig. 18 Prior Art
FIG. 18 is a cross section view of a prior art carrier distorted by abrading friction forces.

FIG. 18 is a cross section view of a conventional prior art pneumatic bladder type of wafer carrier where the bladder is distorted laterally by abrading friction forces that are imposed by a moving CMP abrasive pad. A rotatable wafer carrier head 443 having a wafer carrier hub 478 is attached to the rotatable head (not shown) of a polishing machine tool (not shown) where the carrier hub 478 is loosely attached with flexible joint device 488 and a rigid slide-pin 486 to a rigid carrier plate 474. The cylindrical rigid slide-pin 486 can move along a cylindrical hole in the carrier hub 478 which allows the rigid carrier plate 474 to move axially along the hole axis 482 which is also the rotational axis 482 of the carrier head 443 where the movement of the carrier plate 474 is relative to the carrier hub 478. The rigid slide-pin 486 is attached to a flexible diaphragm that is attached to carrier plate 474 which allows the carrier plate 474 to be spherically rotated about a rotation point relative to the rotatable carrier hub 478 that is remains aligned with its rotational axis 482.

A sealed flexible elastomeric diaphragm device has a number of individual annular sealed pressure chambers 495 and a circular center chamber where the air pressure can be independently adjusted for each of the individual chambers 495 to provide different abrading pressures to a wafer workpiece 496 that is attached to the wafer mounting surface of the elastomeric diaphragm. A wafer 496 carrier annular back-up ring 492 provides containment of the wafer 496 within the rotating but stationary-positioned wafer carrier head as the wafer 496 abraded surface 459 is subjected to abrasion-friction forces by the moving abrasive coated platen 490. An air-pressure annular bladder applies controlled contact pressure of the wafer 496 carrier annular back-up ring 492 with the platen 490 abrasive CMP pad 473 surface where the CMP pad 473 is attached to the platen 490 surface. Controlled-pressure air is supplied from air inlet passageways 480 and 484 in the carrier hub 478 to each of the multiple flexible pressure chambers 495 by flexible tubes 476.

The abrading friction forces act on the wafer 496 abraded surface in a direction that the platen 490 abrasive CMP pad 473 moves where the forces act on the sealed flexible elastomeric diaphragm device which translates the wafer mounting surface of the elastomeric diaphragm and the wafer 496 where the peripheral edge 489 of the wafer 496 is forced at a location 494 against the rigid wafer retaining ring 499 that is attached to the carrier plate 474. The flexible elastomeric chamber walls 498 of the sealed flexible elastomeric diaphragm device are distorted from their non-force stressed original shapes that exist when the abrading forces are not present.

When the wafer 496 is moved into contact with the rigid wafer retaining ring 499 at a location 494, a corresponding gap 467 exists between the peripheral edge 494 of the wafer 496 and the rigid wafer retaining ring 499 in a location that is diagonally across the abraded surface from the location 494 where the wafer 496 is in forced contact with the rigid wafer retaining ring 499. The forced contact of the wafer 496 moves along the peripheral edge 494 of the wafer 496 as the wafer 496 and the wafer carrier head 443 is rotated while the wafer 496 is in abrading contact with the rotating platen abrasive CMP pad 473. There is a gap distance 502 between the wafer 496 peripheral edge 489 and the wafer 496 carrier annular back-up ring 492 at the location that is diagonally across the abraded surface from the location 494 where the wafer 496 is in forced contact with the rigid wafer retaining ring 499 where the CMP pad 473 has a top surface distortion 503 in the gap distance 502 due to the wafer 496 being forced into the surface depths of the CMP pad 473. Another CMP pad surface distortion 472 exists upstream of the wafer 496 carrier annular back-up ring 492 as the moving CMP pad 473 is forced against the wafer 496 carrier annular back-up ring 492.

The effect of the pneumatic carrier head CMP pad compression ring is helpful but over-wear still occurs at the outer periphery of the wafer. To compensate for this, two separate, but closely adjacent, annular pressure chambers are made a part of the flexible substrate membrane. The localized pressure in each of these chamber zones is controlled independently to correct for the uneven abrading wear there caused by the distorted resilient CMP pad.

The resilient CMP pad has significant surface distortions at the leading edge of the wafer where the moving pad contacts the wafer. Lateral abrading friction surface forces push the wafer and the carrier head flexible wafer-attachment membrane away form the wafer retaining ring at this wafer leading edge location. The movement of the wafer away from the wafer retaining ring at this location produces a gap between the wafer leading edge and the retaining ring. The surface of the compressed resilient CMP pad tends to distort in this gap which creates extra-high abrading pressures at the leading edge of the wafer. These high abrading pressures at the outer periphery of the wafer tends to produce over-wear of the wafer in this annular peripheral region. Almost all wafers that are polished with the resilient CMP abrasive slurry pads have non-flat outer periphery bands that are highly undesirable, due to this pad distortion effect.

The wafer carrier heads have rigid wafer carrier plate that has a spherical center of rotation that is offset a distance from the abraded surface of the wafer. When the wafer is polished, the large abrading lateral friction force acts along the abraded surface of the wafer. This friction force can range from 200 to 900 lbs. Because the friction force is applied at an offset pivot distance from the spherical center of rotation, this friction force tends to tilt the wafer as it is being polished. Tilting the wafer as it is being abraded can cause the wafer to have an undesirable non-flat surface.

This same "spherical-action" motion of the rigid carrier head plate occurs when this wafer carrier head is used to CMP polish wafers that contact the flat abrasive surface of a fixed-abrasive raised-island web that is supported by a flat-surfaced rotation platen. Because the centering post is used to transmit the large lateral friction force to the carrier drive hub (the flexible elastomer top diaphragms are very weak), the centering post must be large enough and stiff enough to transmit these large lateral abrading friction forces. Also, it is necessary for the centering post to slide along the axis of the carrier drive hub to allow the substrate carrier to move vertically to provide translation for making and separating abrading contact of the substrate with the CMP pad.

Air or water pressure can be applied to different parts of a pneumatic wafer carrier head. The overall "global" total abrading force on a wafer can be controlled by applying fluid pressure to the rigid carrier plate. This carrier plate supports the flexible wafer attachment membrane. Then regional annular chambers of the flexible wafer membrane can be independently pressurized to apply different abrading pressures to different radial portions of the wafer. These independent pneumatic chambers expand and contract in reaction to the air pressure applied to each one. Each of the annular abrading pressure-controlled zones provides an "average" pressure for that annular segment to compensate for the non-linear wear rate that occurs in the annular band area of the wafer surface.

The very inner circular portion of the wafer typically experiences a very low abrading wear rate. This occurs often because of the localized very slow abrading speed that exists at the center portion of a rotating wafer. To compensate for the slow abrading rate at the center of the wafer, a circular pressurized chamber in the wafer substrate membrane is used to apply an extra-high abrading force at the center of the wafer. This higher pressure compensates for the low abrading speed with the result that uniform material removal is provided at the center of the wafer.

Separation of a wafer from the flexible membrane after the wafer polishing has been completed can be difficult because of the adhesion of the water-wetted wafer to the flexible membrane. To help wafer separation, special low friction coatings can be applied to the membrane flat surface to diminish the wafer-adhesion effect of the smooth-surfaced membrane elastomer material. Expansion of individual annular pressure chambers is often used to distort localized portions of the bottom flat surface of the wafer membrane enough that the rigid flat-surfaced wafer is separated from the membrane.

When higher localized abrading pressures are applied at the center of the wafer to equalize wafer-surface material removal, this increased pressure tends to cause overheating of the center portion of a wafer. Higher abrading pressures cause more abrading-friction heating of that portion of the wafer. This over-heating of the wafer center also raises the temperature of the annular portion of the rotating CMP pad that contacts the high-temperature center portion of the wafer. Thermal scans of the rotating CMP pad that is being subjected to abrading with this type of wafer carrier head shows a distinct annular band of the pad having high temperature which correspond to the location of the rotating wafer as it is held in abrading contact with the rotating pad.

Heat transfer across the full surface of the pad is quite ineffective in reducing the temperature differential across the radial width of the rotating pad. Due to the characteristics of the pad system, the porous foam resilient pad is relatively thick and acts as an insulator. This prevents heat generated on the pad exposed surface from being transferred to the rotary rigid metal platen that the pad is mounted on.

Also, very small quantities of fresh, new, and cool, liquid abrasive slurry mixture are applied to the rotating pad surface. This added slurry liquid does little to cool the pad hot-spot annular areas because the cool slurry is applied uniformly across the radial width of the pad as it rotates. Here, the hot annular band on the pad remains at a higher temperature than adjacent annular areas of the pad that are subjected to lower abrading pressures by the annular-segmented wafer carrier head. These low-pressure annular areas of the pad experience less abrading friction where less friction heat is generated and these annular areas of the pad run cooler than the high abrading pressure areas of the pad.

To reach equilibrium material removal conditions for wafer polishing due to annular temperature gradients across the radial width of the pad, it is often necessary to process up to 100 wafers to reach this equilibrium. The pressure settings for the individual annular zones are different at the start-up of a wafer polishing tool (machine) operation after the polishing tool has been at rest for some time. After many wafers are continually processed in sequence, thermal equilibrium of the pad (and wafer) is reached and the zoned pressure settings are stabilized.

These pneumatic wafer carrier heads are also used with a fixed-abrasive web that is stretched across the flat surface of a rotating platen. Both the carrier head and the abrasive web are typically rotated at the same speeds.

Because of the extreme difficulty of providing and maintaining precision alignment substrate carrier wafer mounting surface and a flat-surfaced abrading surface, resilient support pads are used for both fixed-abrasive web systems and the CMP pad loose-abrasive polishing systems. In the case of the CMP pad, the resilient pad provides global support across the full surface of the wafer. The resilient CMP pad also provides localized support of the abrasive media to compensate for out-of-plane defects on the wafer surface and for out-of-plane defects of the CMP pad itself.

In the case of the fixed-abrasive island-type web, a resilient pad is positioned between a non-precision flat (more than 0.0001 inches) semi-rigid but yet flexible plastic (polycarbonate) web support plate and the flat surface of a rigid rotatable platen. This semi-rigid 0.030 inch thick polycarbonate web-support plate does not provide localized support of the abrasive web to compensate for out-of-plane defects on the wafer surface and for out-of-plane surface defects of the polycarbonate support plate itself. However, the resilient CMP pad does provide global support across the full surface of the wafer.

The pneumatic wafer carrier heads also cause significant localized distortion of the fixed-abrasive webs as the rotating carrier head traverses across the surface of the web. The resilient pad that supports the polycarbonate web-support plate is very flexible and subject to localized distortion by the very large abrading forces applied by the carrier head.

Also, the polycarbonate support plate does not have the capability to be maintained in a precision-flat condition over a long period of time. As a plastic material, the thin polycarbonate plate will tend to assume localized distortions caused by deflections from high-force (100 to 300 lb) contact with rotating carrier head as the platen that supports the abrasive-web device rotates. As the carrier head "travels" across the surface of the polycarbonate plate, that localized portion of the plate is distorted as it is pressed down into the depths of the resilient CMP during each revolution of the abrasive-web support platen.

Further, the use of different annular zones of the carrier head can result in different localized distortions of the polycarbonate web-support plate. All plastic materials such as polycarbonate and a resilient foam CMP pad have a hysteresis damping-effect where it takes some time for a plastic material to recover it original shape after it has been distorted. This means that some recovery time is required for a plastic web-support plate to assume its original localized flatness after the carrier head has passed that location. The abrading speed of this abrasive-web system is highly limited, in part, by this dimensional hysteresis-recovery consideration.

The conventional pneumatic-chamber wafer carrier heads that are in widespread use have a number of disadvantages. These pneumatic-chamber wafer carrier head devices depend on the body of the silicon wafers to resist essentially all of the abrading friction forces that are applied to the flat abraded surface of the wafer by forcing the circular wafer peripheral edge into running contact with a circular rigid wafer retainer ring that surrounds the wafer.

By comparison, the wafer carrier heads described here prevent running contact of the wafer edge with a rigid body as the wafer is rotated. Instead, a circular wafer workpiece is attached and temporarily bonded to the flat surface of a circular rigid wafer carrier rotor disk. The outer periphery of the circular carrier rotor contacts a set of multiple stationary roller idlers as the carrier rotor and the attached wafer rotate during an abrading procedure. The abrading forces that are applied to the rotating wafer abraded surface are transmitted by the adhesive-type bond of the wafer to the wafer carrier rotor which transmits these abrading forces to the stationary roller idlers. The temporary bond of the wafer to the wafer carrier can be accomplished with the use of vacuum or a low-tack adhesive. There is no motion of the wafer substrate workpiece relative to the flat surface of the wafer carrier rotor during the abrading procedures as the wafer is structurally bonded to the wafer carrier rotor during the time of the abrading procedure. After the wafer surface abrading procedure is completed, the wafer is separated form the wafer carrier surface.

The flexible elastomer diaphragm wafer holder is designed to be weak or compliant with little stiffness in a lateral direction that is parallel to the wafer abraded surface. When the typical large abrading forces are applied to the wafer that is attached to the elastomer diaphragm, these friction forces distort the diaphragm by moving the lower portion of the diaphragm laterally. Here, the silicon semiconductor wafer that is very rigid in the direction parallel to the abraded surface of the wafer is used as the supporting member that minimizes the distortion of the elastomer wafer carrier diaphragm. However, most all of the lateral friction forces that are applied to the wafer are resisted when the circular rigid wafer peripheral edge contacts the rigid circular wafer retaining ring at a single point on the wafer peripheral edge.

The abrading friction forces are consistently aligned in the same direction relative to the abrading machine as they originate on the abraded surface of the rotary platen as it rotates. However, the wafer also rotates independently as this constant-direction friction force is imposed on it. Because the "stationary" fixed-position wafer rotates, the friction force is continually applied in a different direction relative to a specific location on the wafer. Rotation of the wafer results in the wafer peripheral edge being contacted at a single-point position that "moves" around the periphery of the wafer. This single-point contact moves around the full circumference of the wafer for each revolution of the wafer.

The wafer outside diameters are smaller than the inside diameters of the rigid wafer retaining rings to allow the wafers to be inserted into the retaining ring at the start of a wafer lapping or polishing procedure. Because the wafers are smaller than the retaining rings, there is a gap between the wafer outside periphery edge and the retaining ring at a position that is diagonally across the wafer abraded surface from the point where the wafer is driven against the retainer ring by the abrading friction force.

Rotation of the abraded wafer results in the wafer actively moving laterally where the rigid but fragile silicon wafer edge is driven to impact the rigid wafer retaining ring. This wafer impact action often results in chipping of the wafer edge. Also, this wafer impact action tends to produce uneven wear of the inside diameter of the rigid retainer ring. In order to sustain this wafer-edge impact action without wafer damage, the wafer thickness must be made sufficiently thick to provide sufficient strength and stiffness to resist the very large and changing abrading friction forces. Typically the wafers have a thickness of 0.030 inches (0.76 mm) to provide the required thickness of the wafer and to minimize chipping of the fragile wafer edge. After a wafer is fully processed to provide the semiconductor circuits, the wafers are typically back-side ground down to a wafer thickness of less than 0.005 inches (0.127 mm).

The lateral abrading friction forces for a 12 inch (300 mm) diameter wafer can easily exceed 500 lbs during a wafer polishing procedure. Most of this large friction force is resisted by the wafer edge that impacts the rigid wafer retainer ring.

The pneumatic elastomer diaphragm carrier head is typically operated very slowly at speeds of approximately 30 rpm. In order to provide sufficient abrading action wafer material removal rates, large abrading pressures are used. However, when high-speed lapping or polishing is done using raised-island abrasive disks on the wafer abrading system described here, the abrading speeds are high but the abrading pressures are very low. The low abrading pressure results in low abrading friction forces that are applied to the wafer abraded surfaces during a wafer lapping or polishing procedure. Lower abrading friction forces results in lesser wafer bonding forces that are required to maintain attachment of the wafers to the wafer carrier heads.

With the elastomeric diaphragm wafer carrier head, wafers do not have to attached with substantial bonding strength to the surface of the bottom flat surface of the elastomeric diaphragm because essentially all of the abrading friction forces are resisted by the rigid wafer peripheral edge being forced against the rigid wafer retainer ring. There is little requirement for these abrading forces to be transferred to the very flexible and compliant wafer carrier diaphragm. In the present wafer lapping or polishing system, the wafer must be attached or adhesively bonded to the rigid circular rotatable wafer attachment plate or wafer carrier rotor with substantial wafer bonding strength where the rotor is held in a fixed wafer-rotational position by running rolling contact of the rotating wafer with stationary roller idlers mounted on the stationary wafer carrier rotor housing.

Vacuum can be used very effectively to temporarily bond the wafers to the flat surfaces of the wafer rotor carriers with substantial wafer bonding strength. For example, a vacuum induced wafer hold-down attachment force typically exceeds 1,000 lbs when using only 10 psig of vacuum on a 12 inch (300 mm) wafer that has over 100 square inches of surface area. With the system here, the wafer must be structurally bonded to the wafer carrier rotor to prevent movement of the wafer relative to the surface of the wafer rotor when large abrading forces are imposed on the wafer abraded surface.

By comparison, wafers can be "casually attached" to an elastomer diaphragm type wafer carrier having a elastomeric flat wafer mounting surface simply by using water as a wafer bonding agent. All the abrading friction forces that are applied to the wafer are resisted by the rigid wafer itself as the wafer peripheral edge contacts the rigid wafer retaining ring. The elastomeric diaphragm is very flexible in the direction of the plane of the wafer abraded surface so little bonding force is required to keep the wafer successfully bonded to the surface of the flexible elastomeric diaphragm. Here, the elastomeric device distorts to allow the diaphragm bottom flat wafer-mounting surface to simply move along with the attached wafer toward the wafer retainer ring as the wafer rotates. The wafer water-adhesion of the wafer to the diaphragm bottom flat wafer-mounting surface only has to be strong enough to distort the flexible and weak elastomeric diaphragm device as the abrading friction continually moves the wafer into point contact with the wafer retaining ring.

When a rigid wafer rotor is used, the wafer attachment surface of the rotor is preferred to be flat within 0.0001 inches (2.5 microns) to assure that the uniform abrading of a wafer surface takes place when it is abraded by a rigid abrading surface.

Single or multiple individual workpieces such as small-sized wafers or other workpieces including lapped or polished optical devices or mechanical sealing devices can be adhesively attached to a flexible polymer or metal backing sheet. This flexible sheet backing can then be attached with substantial bonding force to the rotatable workpiece rotor with vacuum. These flexible adhesive backing sheets can be easily separated from the rotor after the lapping or polishing is completed by peeling-away the flexible attachment sheet from the individual workpieces.

There are a number of different embodiments of spherical-action rotary workholder devices that offer great simplicity and flexibility for lapping or polishing operations. They can also be used effectively to provide very substantial increases of production speeds as compared to conventional systems used for lapping, polishing and abrading operations. Substantial cost savings are experienced by using these air bearing carriers that allow these abrading processes to be successfully speeded-up.

Figure 1:
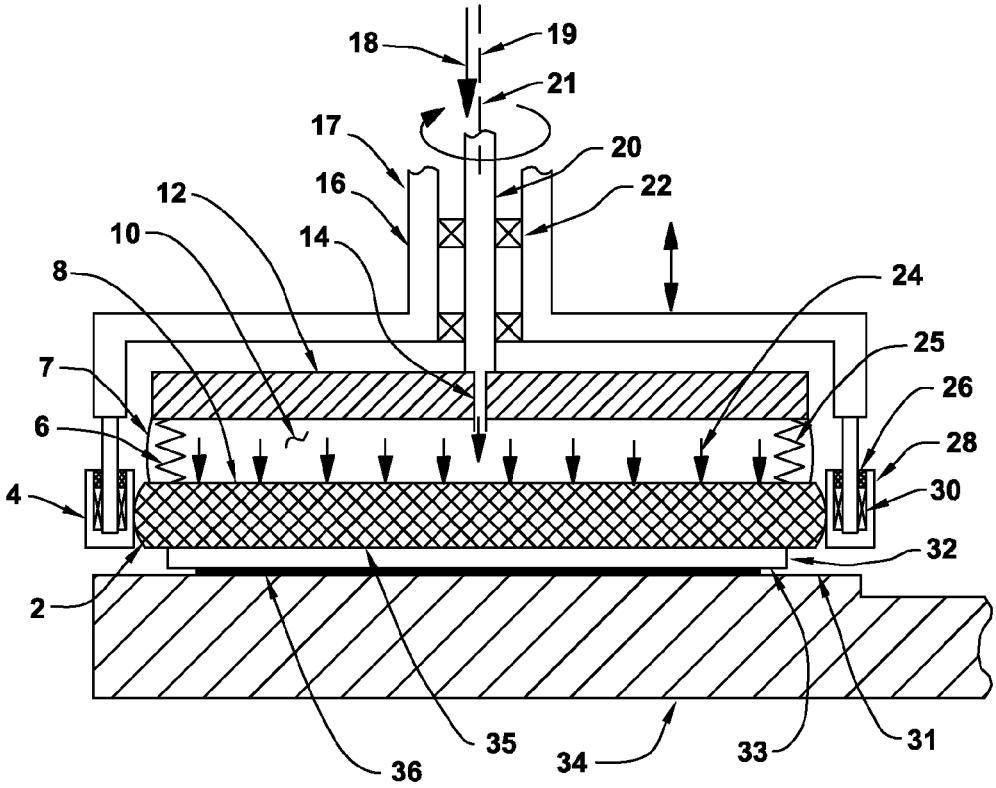
FIG. 1 is a cross section view of a bellows driven wafer polishing workpiece carrier.

FIG. 1 is a cross section view of a bellows driven floating workpiece carrier used for lapping or polishing semiconductor wafers or other workpiece substrates. A stationary workpiece carrier head 17 has a flat-surfaced workpiece 32 that is attached to a floating workpiece carrier rotor 35 that is rotationally driven by a flexible bellows device 6 that is attached to a drive plate 12. The nominally-horizontal drive plate 12 is attached to a hollow drive shaft 20 having a rotation axis 19 that is supported by bearings 22 that are supported by a stationary carrier housing 16 where the carrier housing 16 can be raised and lowered in a vertical direction. The flexible bellows device 6 that is attached to the drive plate 12 is also attached to the workpiece carrier rotor 35 that is rotationally driven by the flexible bellows device 6. The workpiece carrier rotor 35 has an outer periphery 2 that has a spherical shape which allows the workpiece carrier rotor 35 outer periphery 2 to remain in contact with stationary roller idlers 28 when the rotating carrier rotor 35 is tilted.

The workpiece carrier rotor 35 has a rotation axis 21 that is coincident with the hollow drive shaft 20 rotation axis 19 to avoid interference action of the workpiece carrier rotor 35 with the hollow drive shaft 20 when the hollow drive shaft 20 is rotated. The workpiece 32 carrier rotor 35 rotation axis 21 is positioned to be coincident with the hollow drive shaft 20 rotation axis 19 by the controlled location of the stationary roller idlers 28 that are mounted to the Rolling contact of the workpiece carrier rotor 35 outer periphery 2 with the set of stationary roller idlers 28 that are precisely located at prescribed positions assures that the workpiece carrier rotor 35 rotation axis 21 is coincident with the hollow drive shaft 20 rotation axis 19. The stationary roller idlers 28 are mounted at positions on the carrier housing 16 where the diameters of the stationary roller idlers 28 and the diameters of the respective workpiece carrier rotors 35 are considered in the design and fabrication of the workpiece carrier head 17 to provide that the workpiece carrier rotor 35 rotation axis 21 is precisely coincident with the hollow drive shaft 20 rotation axis 19.

If the workpiece carrier rotor 35 rotation axis 21 is positioned to be offset a distance from the hollow drive shaft 20 rotation axis 19 then the flexible bellows device 6 that is attached to both the workpiece carrier rotor 35 and to the drive plate 12 that is attached to the hollow drive shaft 20 will experience an undesirable lateral distortion in a horizontal direction.

Lateral horizontal distortion of the flexible bellows device 6 can produce interference action of the workpiece carrier rotor 35 with the hollow drive shaft 20 when the hollow drive shaft 20 is rotated. Interference action of the workpiece carrier rotor 35 with the hollow drive shaft 20 during rotation of the hollow drive shaft 20 can cause undesirable variations in the speed of rotation of the workpiece 32 that is in abrading contact with the abrasive 36 coating on the rotary platen 34. The variations in the speed of rotation of the workpiece 32 would be periodic with every revolution of the workpiece 32 and would tend to create uneven abrasion patterns on the abraded surface of an expensive workpiece such as a semiconductor wafer, especially when the workpiece 32 is rotated at the high rotational speeds used for high speed lapping or polishing of workpieces 32.

The roller idlers 28 can have a cylindrical peripheral surface 4 or other surface shapes including a "spherical" hourglass type shape and can have low-friction roller bearings 30 or air bearings 30 and roller idler 28 seals 26 shape and can have low-friction roller bearings 30 or air bearings 30 and roller idler 28 seals 26. The roller idler 28 seals 26 prevent contamination of the low-friction roller bearings 30 or air bearings 30 by abrading debris or coolant water or other fluids or materials that are used in the abrading procedures. The air bearings 30 can provide zero friction and can rotate at very high speeds when the workpiece carrier rotor 35 is rotated at speeds of 3,000 rpm or more that are typically used in high speed flat lapping. Because the diameters of the roller idlers 28 are typically much smaller than the diameters of the workpiece carrier rotors 35 the roller idlers 28 typically have rotational speeds that are much greater than the rotational speeds of the workpiece carrier rotors 35.

Pressurized air or another fluid such as water 18 is supplied through the hollow drive shaft 20 that has a fluid passage 14 that allows pressurized air or another fluid such as water 18 to fill the sealed chamber 10 that is formed by the sealed flexible bellows device 6 that has flexible annular-disk pleats 25. This controlled fluid 18 pressure is present in the sealed chamber 10 to provide uniform abrading pressure 24 across the full flat top surface 8 of the carrier rotor 35 where uniform abrading pressure 24 pressure is directly transferred to the workpiece 32 abraded surface 33 that is in abrading contact with the abrasive 36 coating on the rotary platen 34.

The bellows device 6 annular-disk pleats 25 that are joined together at their inside-diameter and outside-diameter peripheral edges allow the bellows device 6 to act as a spring device which can flex vertically with little friction and to have small deflection stiffness in a vertical direction but provides substantial stiffness in a horizontal direction. However, the horizontal-direction stiffness of the bellows device 6 annular-disk pleats 25 does allow a small amount of misalignment to occur between the rotation axis of the drive shaft 20 and the center of rotation of the workpiece carrier rotor 35. The bellows device 6 pleats 25 are very stiff torsionally due to their near-flat mutually edge-joined annular-disk pleat-section members that are nominally horizontal which allows the bellows device 6 to have substantial tensional stiffness for driving the rotation of the workpiece carrier rotor 35. These types of lightweight bellows devices 6 are often used as zero-backlash but flexible shaft drives for machine tool devices.

The workpiece carrier rotor 35 and the flat-surfaced workpiece 32 such as a semiconductor wafer is allowed to be tilted from a horizontal position when they are stationary or rotated by the flexing action provided by the bellows devices 6 that can be operated at very high rotational speeds. The bellows device 6 pleats 25 can be constructed from corrosion-resistant metals such as stainless steel or from polymers such as polyester.

When the flat-surfaced workpiece 32 and the workpiece carrier rotor 35 are subjected to abrading friction forces that are parallel to the abraded surface 33 of the workpieces 32, these abrading friction forces are resisted by the workpiece carrier rotor 35 as it contacts the multiple idlers 28 that are located around the outer periphery of the workpiece carrier rotor 35. The circular drive plate 12 has an outer periphery 2 spherical shape which allows the workpiece carrier rotor 35 outer periphery 2 to remain in contact with the cylindrical-surfaced roller idlers 28 when the rotating carrier rotor 35 is tilted where the stationary-position surfaced roller idlers 28 that are spaced around the outer periphery of the workpiece carrier rotor 35 act together as a centering device that controls the center of rotation of the workpiece carrier rotor 35 as it rotates.

The circular drive plate 12 outer periphery 2 spherical shape provides that the center of rotation of the workpiece carrier rotor 35 remains aligned with the rotational axis of drive shaft 20 when the workpiece carrier rotor 35 is tilted as it rotates. The workpiece carrier rotor 35 can be tilted due to numerous causes including: flat-surfaced workpiece 32 that have non-parallel opposed surfaces; misalignment of components of the stationary workpiece carrier head 17; misalignment of other components of the abrading machine (not shown); a platen 34 that has an abrading surface 31 that is not flat.

A flexible annular band 7 that is impervious to water, abrading fluids and abrading debris that is preferably constructed from a flexible elastomer or polymer material is attached to the circular drive plate 12 and to the workpiece rotor 35 and which surrounds the outer diameter of the bellows device 6 pleats 25 during to prevent contamination of the bellows device 6 pleats 25 during the abrading procedures.

Figure 2:
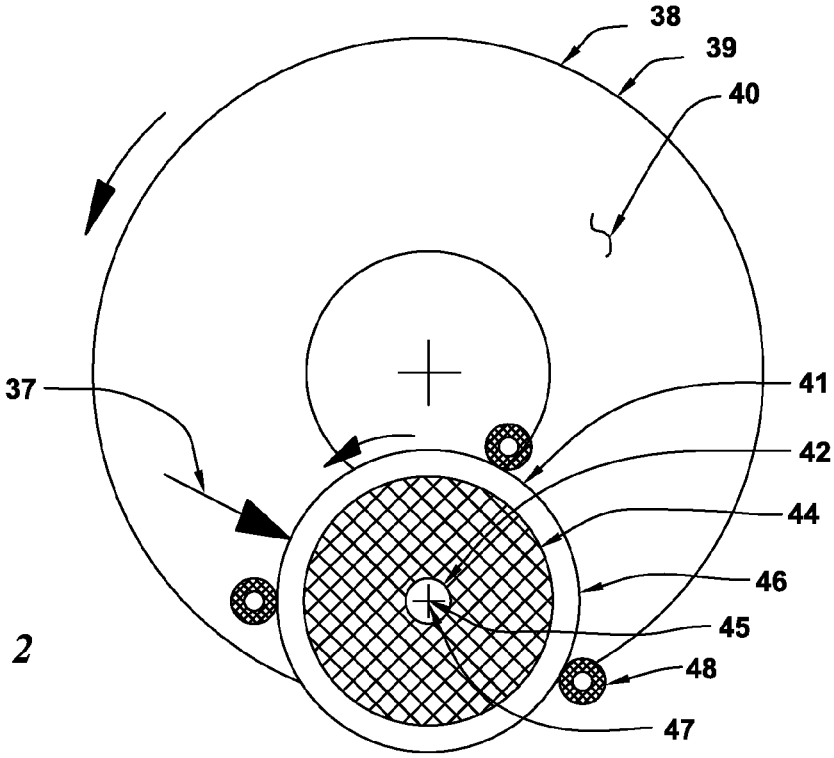
FIG. 2 is a top view of a bellows driven wafer polishing or lapping workpiece carrier.

FIG. 2 is a top view of a bellows driven floating workpiece carrier used for lapping or polishing semiconductor wafers or other workpiece substrates. A stationary workpiece carrier head (not shown) has a flat-surfaced workpiece 44 that is attached to a floating workpiece carrier rotor 46 that is rotationally driven by a flexible bellows device (not shown) that is driven by a rotary drive shaft 42 that is attached to the stationary workpiece carrier head. The floating workpiece cylindrical-shaped carrier rotor 46 having a carrier rotor outer diameter 41 is in rolling-contact with three stationary-position rotatable roller idlers 48 that create and maintain the center of rotation 47 of the carrier rotor 46 as it rotates and is subjected to abrading forces 37. The center of rotation 47 of the carrier rotor 46 must be coincident with the axis of rotation 45 of the carrier rotor 46 hollow drive shaft (not shown). An abrasive disk 38 that has an annular band of abrasive 40 is attached to a rotating platen 39.

Figure 3:
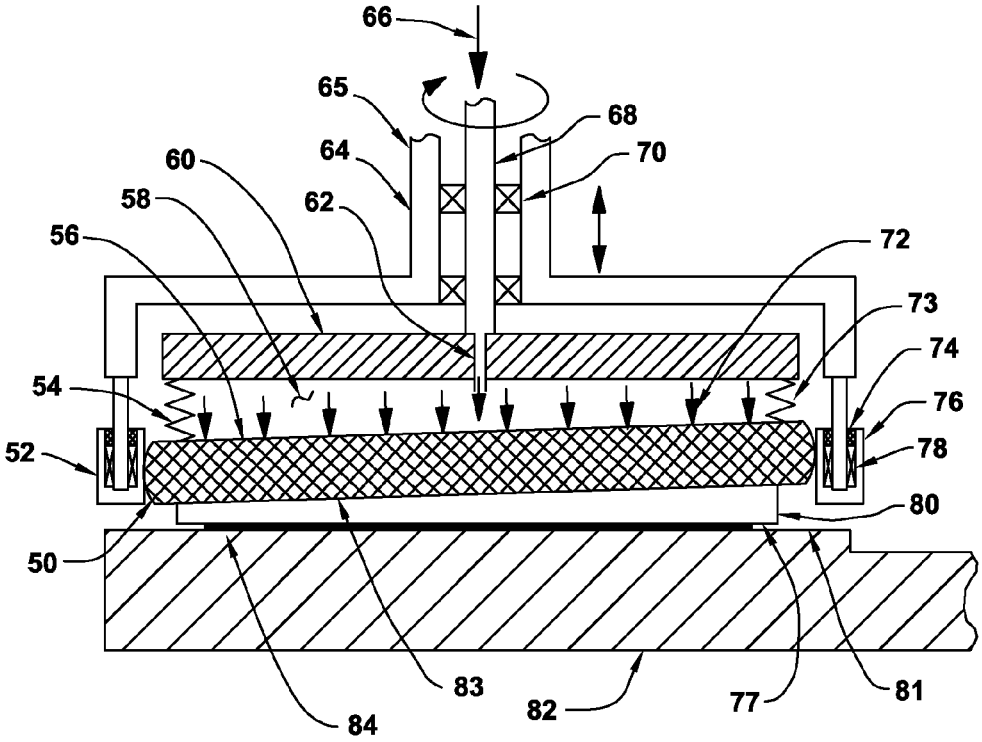
FIG. 3 is a cross section view of a tilted bellows driven workpiece carrier.

FIG. 3 is a cross section view of a bellows driven floating workpiece carrier that has a tilted workpiece. A stationary workpiece carrier head 65 has a flat-surfaced workpiece 80 that is attached to a floating workpiece carrier rotor 83 that is rotationally driven by a flexible bellows device 54 that is attached to a drive plate 60. The nominally-horizontal drive plate 60 is attached to a hollow drive shaft 68 that is supported by bearings 70 that are supported by a stationary carrier housing 64 where the carrier housing 64 can be raised and lowered in a vertical direction. The flexible bellows device 54 that is attached to the drive plate 60 is also attached to the workpiece carrier rotor 83 that is rotationally driven by the flexible bellows device 54. The workpiece carrier rotor 83 has an outer periphery 50 that has a spherical shape which allows the workpiece carrier rotor 83 outer periphery 50 to remain in contact with stationary roller idlers 76 when the rotating carrier rotor 83 is tilted.

The roller idlers 76 can have a cylindrical peripheral surface 52 or other surface shapes including a "spherical" hourglass type shape and can have low-friction roller bearings 78 or air bearings 78 and roller idler 76 seals 74. The roller idler 76 seals 74 prevent contamination of the low-friction roller bearings 78 or air bearings 78 by abrading debris or coolant water or other fluids or materials that are used in the abrading procedures. The air bearings 78 can provide zero friction and can rotate at very high speeds when the workpiece carrier rotor 83 is rotated at speeds of 3,000 rpm or more that are typically used in high speed flat lapping. Because the diameters of the roller idlers 76 are typically much smaller than the diameters of the workpiece carrier rotors 83 the roller idlers 76 typically have rotational speeds that are much greater than the rotational speeds of the workpiece carrier rotors 83.

Pressurized air or another fluid such as water 66 is supplied through the hollow drive shaft 68 that has a fluid passage 62 that allows pressurized air or another fluid such as water 66 to fill the sealed chamber 58 that is formed by the sealed flexible bellows device 54 that has flexible annular-disk pleats 73. This controlled fluid 66 pressure is present in the sealed chamber 58 to provide uniform abrading pressure 72 across the full flat top surface 56 of the carrier rotor 83 where the uniform abrading pressure 72 is directly transferred to the full workpiece 80 abraded surface 77 that is in adding contact with the abrasive 84 coating on the rotary platen 82.

The bellows device 54 annular-disk pleats 73 that are joined together at their inside-diameter and outside-diameter peripheral edges allow the bellows device 54 to act as a spring device which can flex vertically with little friction and to have small deflection stiffness in a vertical direction but provides substantial stiffness in a horizontal direction. However, the horizontal-direction stiffness of the bellows device 54 annular-disk pleats 73 does allow a small amount of misalignment to occur between the rotation axis of the drive shaft 68 and the center of rotation of the workpiece carrier rotor 83. The bellows device 54 pleats 73 are very stiff torsionally due to their near-flat mutually edge-joined annular-disk pleat-section members that are nominally horizontal which allows the bellows device 54 to have substantial tensional stiffness for driving the rotation of the workpiece carrier rotor 83. These types of lightweight bellows devices 54 are often used as zero-backlash but flexible shaft drives for machine tool devices.

The workpiece carrier rotor 83 is allowed to be tilted from a horizontal position when it and the flat-surfaced workpiece 80 such as a semiconductor wafer when they are stationary or rotated by the flexing action provided by the bellows devices 54 that can be operated at very high rotational speeds. Here, a flat-surfaced workpiece 80 that has opposed flat surfaces that are not parallel causes the workpiece carrier rotor 83 having the attached flat-surfaced workpiece 80 to be tilted and the bellows device 54 annular-disk pleats 73 are compressed on one side of the bellows device 54 to compensate for the tilted workpiece carrier rotor 83. As the workpiece 80 and the workpiece carrier rotor 83 rotate, the compressed portion of the bellows device 54 annular-disk pleats 73 travels around the periphery of the stationary carrier housing 64.

Even as the workpiece 80 having non-parallel sides is rotated, the applied abrading pressure 72 remains uniform across the full flat top surface 56 of the carrier rotor 83 where the controlled fluid 66 pressure that causes the uniform applied abrading pressure 72 is directly transferred uniformly to the workpiece 80 abraded surface 77 that is in abrading contact with the abrasive 84 coating on the rotary platen 82. The bellows device 54 pleats 73 can be constructed from corrosion-resistant metals such as stainless steel or from polymers such as polyester.

When the flat-surfaced workpiece 80 and the workpiece carrier rotor 83 are subjected to abrading friction forces that are parallel to the abraded surface 77 of the workpieces 80, these abrading friction forces are resisted by the workpiece carrier rotor 83 as it contacts the multiple idlers 76 that are located around the outer periphery of the workpiece carrier rotor 83.

The workpiece carrier rotor 83 has an outer periphery 50 spherical shape which allows the workpiece carrier rotor 83 outer periphery 50 to remain in contact with the cylindrical-surfaced roller idlers 76 when the rotating carrier rotor 83 is tilted where the stationary-position surfaced roller idlers 76 that are spaced around the outer periphery of the workpiece carrier rotor 83 act together as a centering device that maintains the stationary-position of the original center of rotation of the workpiece carrier rotor 83 as the workpiece carrier rotor 83 rotates.

The workpiece carrier rotor 83 outer periphery 50 spherical shape provides that the center of rotation of the workpiece carrier rotor 83 remains aligned with the rotational axis of drive shaft 68 when the workpiece carrier rotor 83 is tilted as it rotates. The workpiece carrier rotor 83 can be tilted due to numerous causes including: flat-surfaced workpiece 80 that have non-parallel opposed surfaces; misalignment of components of the stationary workpiece carrier head 65; misalignment of other components of the abrading machine (not shown); and a platen 82 that has an abrading surface 81 that is not flat.

Figure 4:
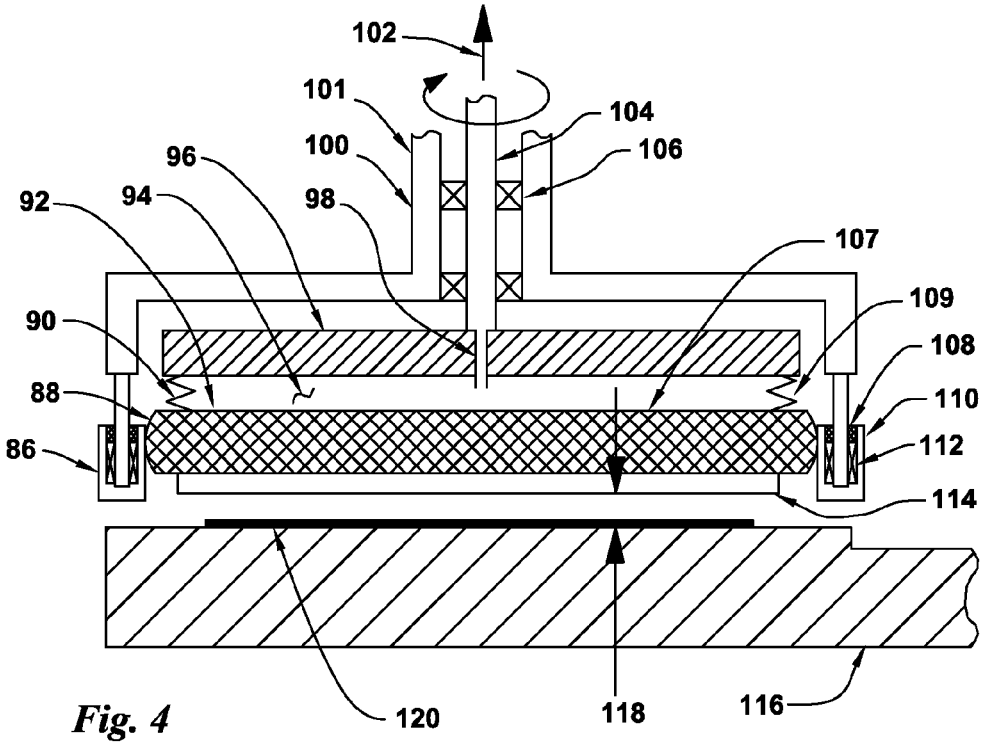
FIG. 4 is a cross section view of a vacuum-raised bellows driven floating workpiece carrier.

FIG. 4 is a cross section view of a bellows driven floating workpiece carrier that is raised using vacuum. A stationary workpiece carrier head 101 has a flat-surfaced workpiece 114 that is attached to a floating workpiece carrier rotor 107 that is rotationally driven by a flexible bellows device 90 that is attached to a drive plate 96. The nominally-horizontal drive plate 96 is attached to a hollow drive shaft 104 that is supported by bearings 106 that are supported by a stationary carrier housing 100 where the carrier housing 100 can be raised and lowered in a vertical direction. The flexible bellows device 90 that is attached to the drive plate 96 is also attached to the workpiece carrier rotor 107 that is rotationally driven by the flexible bellows device 90. The workpiece carrier rotor 107 has an outer periphery 88 that has a spherical shape which allows the workpiece carrier rotor 107 outer periphery 88 to remain in contact with stationary roller idlers 110 when the rotating carrier rotor 107 and the attached workpiece 114 is raised. The workpiece carrier rotor 107 can also be raised to attach workpieces 114 to the carrier rotor 107 or to separate workpieces 114 from the carrier rotor 107.

The roller idlers 110 can have a cylindrical peripheral surface 86 and can have low-friction roller bearings 112 and roller idler 110 seals 108. Vacuum 102 is supplied through the hollow drive shaft 104 that has a fluid passage 98 that allows the sealed chamber 94 that is formed by the sealed flexible bellows device 90 that has flexible annular-disk pleats 109. This vacuum negative 102 pressure is present in the sealed chamber 94 to provide uniform vacuum negative pressure across the full flat top surface 92 of the carrier rotor 107 where the vacuum raises the workpiece carrier rotor 107 and the workpiece 114 a distance 118 from abrading contact with the abrasive 120 coating on a rotary platen 116.

The bellows device 90 annular-disk pleats 109 that are joined together at their inside-diameter and outside-diameter peripheral edges allow the bellows device 90 to act as a spring device which can flex vertically with little friction and to have small deflection stiffness in a vertical direction but provides substantial stiffness in a horizontal direction.

Figure 5:
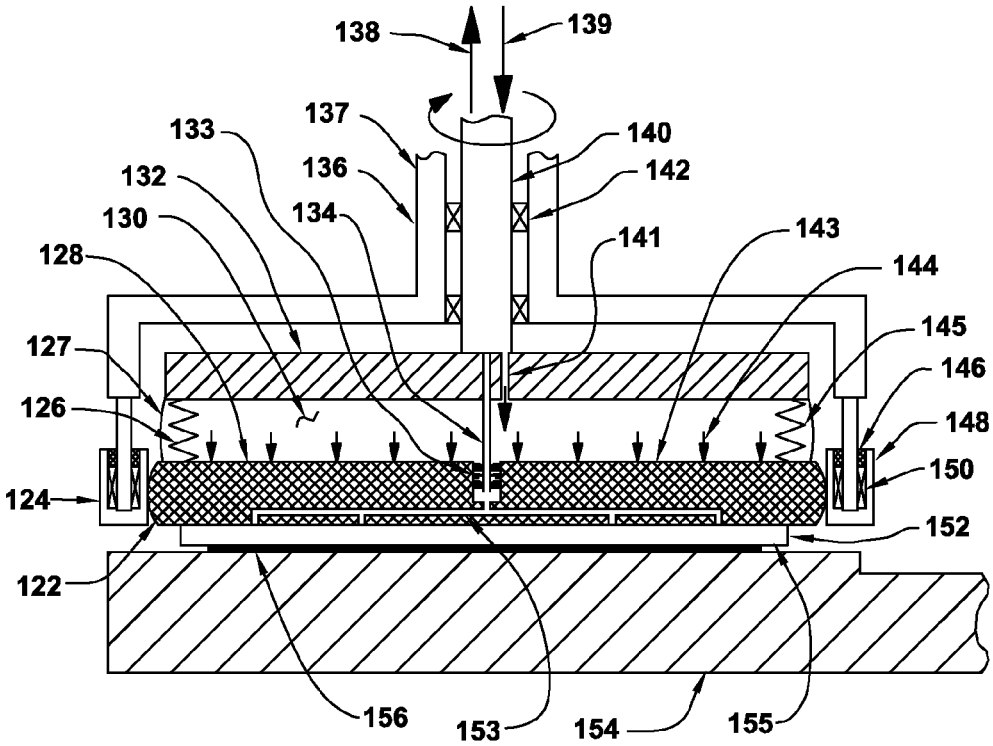
FIG. 5 is a cross section view of a bellows driven carrier with vacuum attached workpieces.

FIG. 5 is a cross section view of a bellows driven floating workpiece carrier having vacuum attached workpieces. A stationary workpiece carrier head 137 has a flat-surfaced workpiece 152 that is attached to a floating workpiece carrier rotor 143 that is rotationally driven by a flexible bellows device 126 that is attached to a drive plate 132. The nominally-horizontal drive plate 132 is attached to a hollow drive shaft 140 having a rotation axis that is supported by bearings 142 that are supported by a stationary carrier housing 136 where the carrier housing 136 can be raised and lowered in a vertical direction. The flexible bellows device 126 that is attached to the drive plate 132 is also attached to the workpiece carrier rotor 143 that is rotationally driven by the flexible bellows device 126. The workpiece carrier rotor 143 has an outer periphery 1142 that has a spherical shape which allows the workpiece carrier rotor 143 outer periphery 122 to remain in contact with stationary roller idlers 148 when the rotating carrier rotor 143 is tilted.

The workpiece carrier rotor 143 has a rotation axis that is coincident with the hollow drive shaft 140 rotation axis 19 to avoid interference action of the workpiece carrier rotor 143 with the hollow drive shaft 140 when the hollow drive shaft 140 is rotated. The workpiece 152 carrier rotor 143 rotation axis is positioned to be coincident with the hollow drive shaft 140 rotation axis by the controlled location of the stationary roller idlers 148 that are mounted to the Rolling contact of the workpiece carrier rotor 143 outer periphery 122 with the set of stationary roller idlers 148 that are precisely located at prescribed positions assures that the workpiece carrier rotor 143 rotation axis is coincident with the hollow drive shaft 140 rotation axis 19. The stationary roller idlers 148 are mounted at positions on the carrier housing 136 where the diameters of the stationary roller idlers 148 and the diameters of the respective workpiece carrier rotors 143 are considered in the design and fabrication of the workpiece carrier head 137 to provide that the workpiece carrier rotor 143 rotation axis is precisely coincident with the hollow drive shaft 140 rotation axis.

If the workpiece carrier rotor 143 rotation axis is positioned to be offset a distance from the hollow drive shaft 140 rotation axis then the flexible bellows device 126 that is attached to both the workpiece carrier rotor 143 and to the drive plate 132 that is attached to the hollow drive shaft 140 will experience an undesirable lateral distortion in a horizontal direction.

Lateral horizontal distortion of the flexible bellows device 126 can produce interference action of the workpiece carrier rotor 143 with the hollow drive shaft 140 when the hollow drive shaft 140 is rotated. Interference action of the workpiece carrier rotor 143 with the hollow drive shaft 140 during rotation of the hollow drive shaft 140 can cause undesirable variations in the speed of rotation of the workpiece 152 that is in abrading contact with the abrasive 156 coating on the rotary platen 154. The variations in the speed of rotation of the workpiece 152 would be periodic with every revolution of the workpiece 152 and would tend to create uneven abrasion patterns on the abraded surface of an expensive workpiece such as a semiconductor wafer, especially when the workpiece 152 is rotated at the high rotational speeds used for high speed lapping or polishing of workpieces 152.

The roller idlers 148 can have a cylindrical peripheral surface 124 or other surface shapes including a "spherical" hour-glass type shape and can have low-friction roller bearings 150 or air bearings 150 and roller idler 148 seals 146 shape and can have low-friction roller bearings 150 or air bearings 150 and roller idler 148 seals 146. The roller idler 148 seals 146 prevent contamination of the low-friction roller bearings 150 or air bearings 150 by abrading debris or coolant water or other fluids or materials that are used in the abrading procedures. The air bearings 150 can provide zero friction and can rotate at very high speeds when the workpiece carrier rotor 143 is rotated at speeds of 3,000 rpm or more that are typically used in high speed flat lapping. Because the diameters of the roller idlers 148 are typically much smaller than the diameters of the workpiece carrier rotors 143 the roller idlers 148 typically have rotational speeds that are much greater than the rotational speeds of the workpiece carrier rotors 143.

Pressurized air or another fluid such as water 139 is supplied through the hollow drive shaft 140 that has a fluid passage 141 that allows pressurized air or another fluid such as water 139 to fill the sealed chamber 130 that is formed by the sealed flexible bellows device 126 that has flexible annular-disk pleats 145. This controlled fluid 139 pressure is present in the sealed chamber 130 to provide uniform abrading pressure 144 across the full top surface 128 of the carrier rotor 143 where uniform abrading pressure 144 pressure is directly transferred to the workpiece 152 abraded surface 155 that is in abrading contact with the abrasive 156 coating on the rotary platen 154.

The bellows device 126 annular-disk pleats 145 that are joined together at their inside-diameter and outside-diameter peripheral edges allow the bellows device 126 to act as a spring device which can flex vertically with little friction and to have small deflection stiffness in a vertical direction but provides substantial stiffness in a horizontal direction. However, the horizontal-direction stiffness of the bellows device 126 annular-disk pleats 145 does allow a small amount of misalignment to occur between the rotation axis of the drive shaft 140 and the center of rotation of the workpiece carrier rotor 143. The bellows device 126 pleats 145 are very stiff torsionally due to their near-flat mutually edge-joined annular-disk pleat-section members that are nominally horizontal which allows the bellows device 126 to have substantial tensional stiffness for driving the rotation of the workpiece carrier rotor 143. These types of lightweight bellows devices 126 are often used as zero-backlash but flexible shaft drives for machine tool devices.

The workpiece carrier rotor 143 and the flat-surfaced workpiece 152 such as a semiconductor wafer is allowed to be tilted from a horizontal position when they are stationary or rotated by the flexing action provided by the bellows devices 126 that can be operated at very high rotational speeds. The bellows device 126 pleats 145 can be constructed from corrosion-resistant metals such as stainless steel or from polymers such as polyester.

When the flat-surfaced workpiece 152 and the workpiece carrier rotor 143 are subjected to abrading friction forces that are parallel to the abraded surface 155 of the workpieces 152, these abrading friction forces are resisted by the workpiece carrier rotor 143 as it contacts the multiple idlers 148 that are located around the outer periphery of the workpiece carrier rotor 143. The circular drive plate 132 has an outer periphery 122 spherical shape which allows the workpiece carrier rotor 143 outer periphery 122 to remain in contact with the cylindrical-surfaced roller idlers 148 when the rotating carrier rotor 143 is tilted where the stationary-position surfaced roller idlers 148 that are spaced around the outer periphery of the workpiece carrier rotor 143 act together as a centering device that controls the center of rotation of the workpiece carrier rotor 143 as it rotates.

The circular drive plate 132 outer periphery 122 spherical shape provides that the center of rotation of the workpiece carrier rotor 143 remains aligned with the rotational axis of drive shaft 140 when the workpiece carrier rotor 143 is tilted as it rotates. The workpiece carrier rotor 143 can be tilted due to numerous causes including: flat-surfaced workpiece 152 that have non-parallel opposed surfaces; misalignment of components of the stationary workpiece carrier head 137; misalignment of other components of the abrading machine (not shown); a platen 154 that has an abrading surface 31 that is not flat.

A flexible annular band 127 that is impervious to water, abrading fluids and abrading debris that is preferably constructed from a flexible elastomer or polymer material is attached to the circular drive plate 132 and to the workpiece rotor 143 and which surrounds the outer diameter of the bellows device 126 pleats 145 during to prevent contamination of the bellows device 126 pleats 145 during the abrading procedures.

Vacuum 138 is routed through the hollow drive shaft 140 and through the flexible tube 134 that slides into the flexible tube slideable seal 133 that is attached to the workpiece rotor 143 and provides vacuum 138 to the vacuum passageways 153 that provide attachment of the wafers or workpieces 152 to the workpiece rotor 143.

Figure 6:
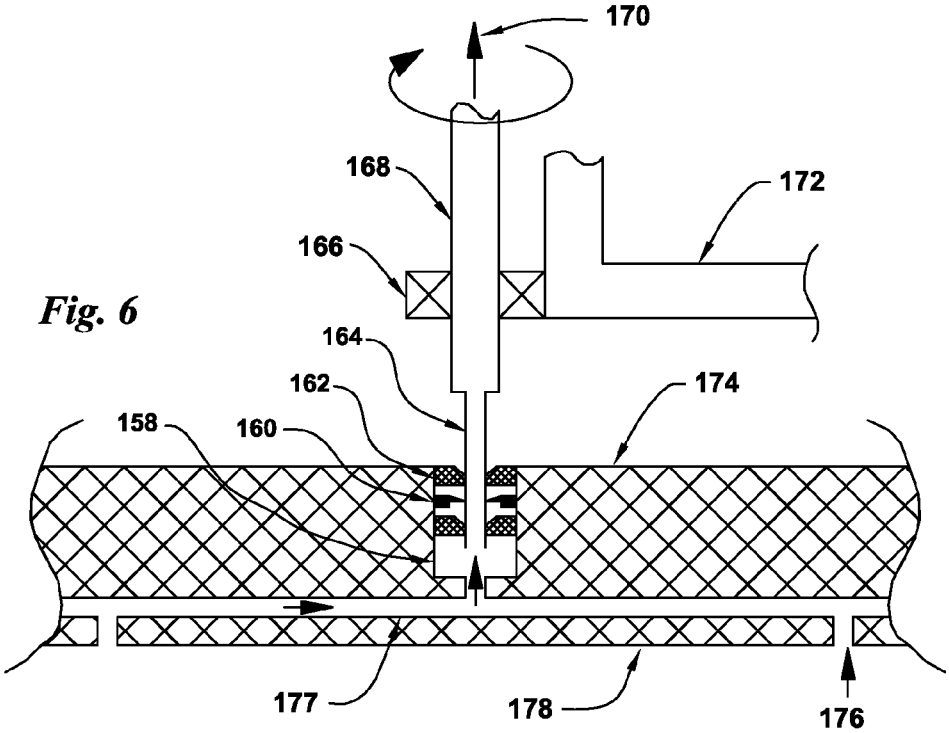
FIG. 6 is a cross section view of a wafer vacuum attachment device with a flexible tube.

FIG. 6 is a cross section view of a wafer vacuum attachment device that uses a flexible vacuum tube. Vacuum 170 is routed through the hollow drive shaft 168 and through the flexible tube 164 that slides into the flexible tube slideable seal 160 that is attached to the nominally-horizontal workpiece rotor 174 where the flexible tube 164 is guided and positioned by tube guides 162 that are attached to the workpiece rotor 174. The flexible tube 164 provides vacuum 170 to a vacuum chamber 158 that supplies vacuum 170 to the vacuum passageways 177 that provides vacuum 170 to the vacuum port holes 176 that are used to provide attachment of the wafers or workpieces (not shown) to the workpiece rotor 174 wafer mounting surface 178. The hollow drive shaft 168 is supported by bearings 166 that are supported by a stationary carrier housing 172 where the carrier housing 172 can be raised and lowered in a vertical direction.

Figure 7:
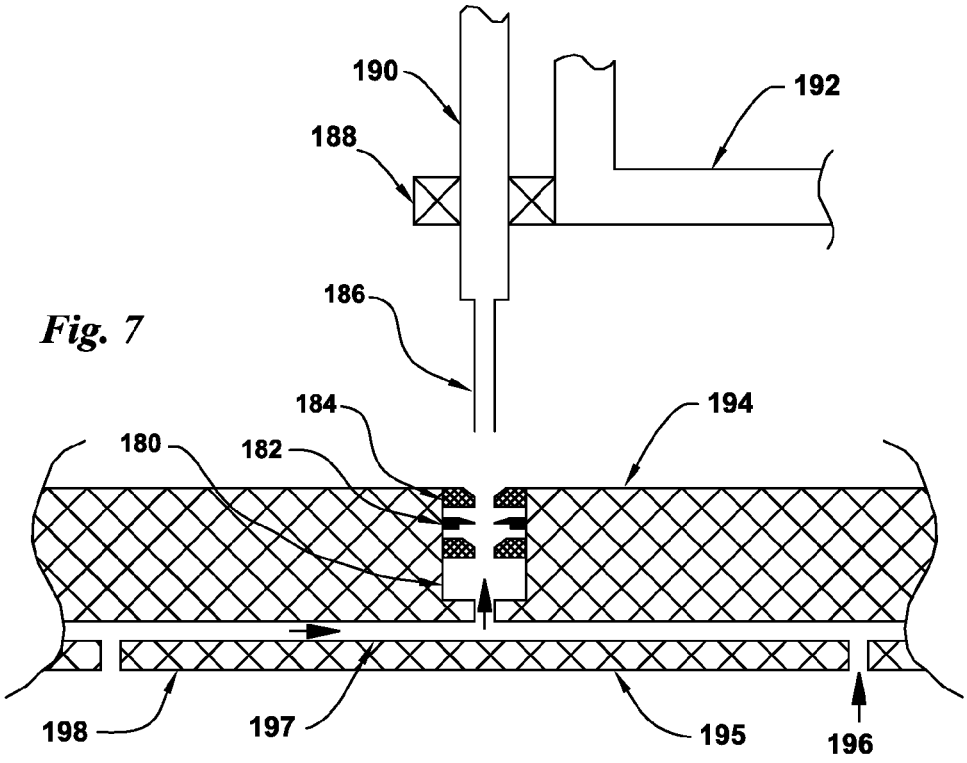
FIG. 7 is a cross section view of a wafer attachment device with a separated vacuum tube.

FIG. 7 is a cross section view of a wafer vacuum attachment device that uses a flexible vacuum tube where the rotatable wafer rotor is separated from the stationary carrier housing. Vacuum is routed through the hollow drive shaft 190 and through the flexible tube 186 that slides into the flexible tube slideable seal 182 that is attached to the nominally-horizontal workpiece rotor 194 where the flexible tube 186 is guided and positioned by tube guides 184 that are attached to the workpiece rotor 194. The flexible tube 186 provides vacuum to a vacuum chamber 180 that supplies vacuum to the vacuum passageways 197 that provides vacuum to the vacuum port holes 196 that are used to provide attachment of the wafers or workpieces (not shown) to the workpiece rotor 194 wafer mounting surface 195. The hollow drive shaft 190 is supported by bearings 188 that are supported by a stationary carrier housing 192 where the carrier housing 192 can be raised and lowered in a vertical direction. The carrier housing 192 is shown in a raised position where there is a space gap between the free end of the flexible tube 186 and the flexible tube 186 guides 184 that are attached to the workpiece rotor 194.

Figure 8:
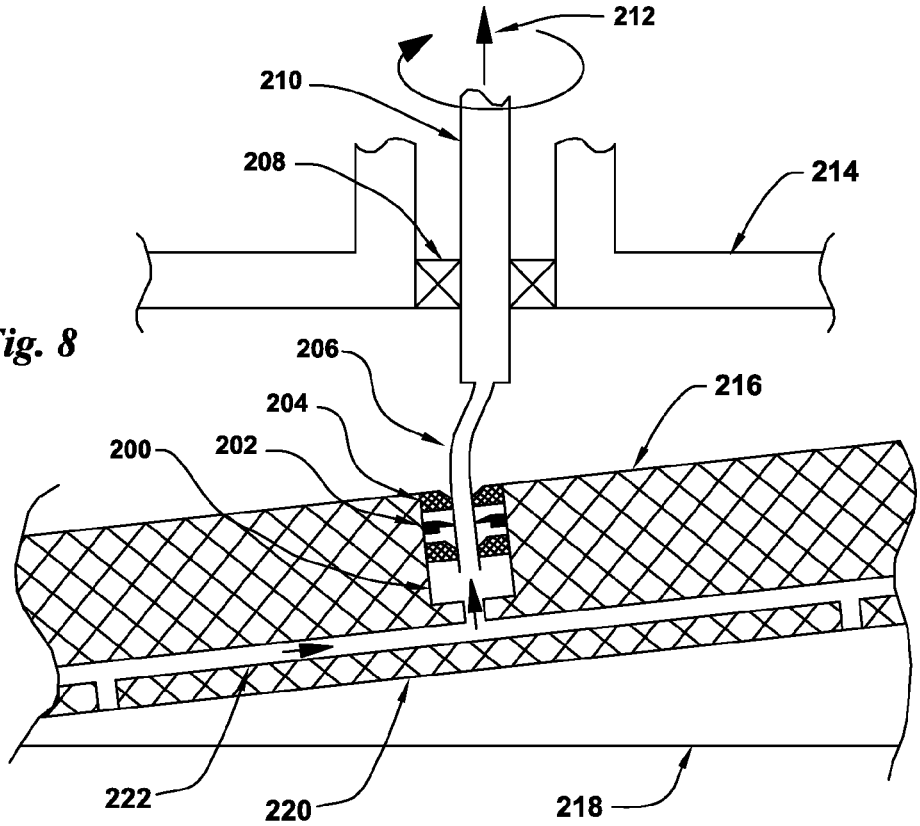
FIG. 8 is a cross section view of a wafer attachment device with a distorted vacuum tube.

FIG. 8 is a cross section view of a wafer vacuum attachment device that uses a flexible vacuum tube that is distorted. Vacuum 212 is routed through the hollow drive shaft 210 and through the flexible tube 206 that slides into the flexible tube slideable seal 202 that is attached to the nominally-horizontal workpiece rotor 216 where the distorted flexible tube 206 is guided and positioned by tube guides 204 that are attached to the workpiece rotor 216. The flexible tube 206 provides vacuum 212 to a vacuum chamber 200 that supplies vacuum 212 to the vacuum passageways 222 that provides vacuum 212 to the vacuum port holes that are used to provide attachment of the wafers or workpieces 218 having non-parallel flat surfaces to the workpiece rotor 216 wafer mounting surface 220.

The wafers or workpieces 218 having non-parallel flat surfaces tilts the workpiece rotor 216 which distorts the flexible tube 206 having a smooth exterior surface that is guided and positioned by tube guides 204 that allow the flexible tube slideable seal 202 to seal the flexible tube 206 against vacuum leaks even though the flexible tube 206 is distorted. The flexible tube 206 smooth exterior surface prevents excessive wear of the tube guides 204 and the flexible tube slideable seals 202 when the workpiece rotor 216 is rotated. The hollow drive shaft 210 is supported by bearings 208 that are supported by a stationary carrier housing 214 where the carrier housing 214 can be raised and lowered in a vertical direction.

Figure 9:
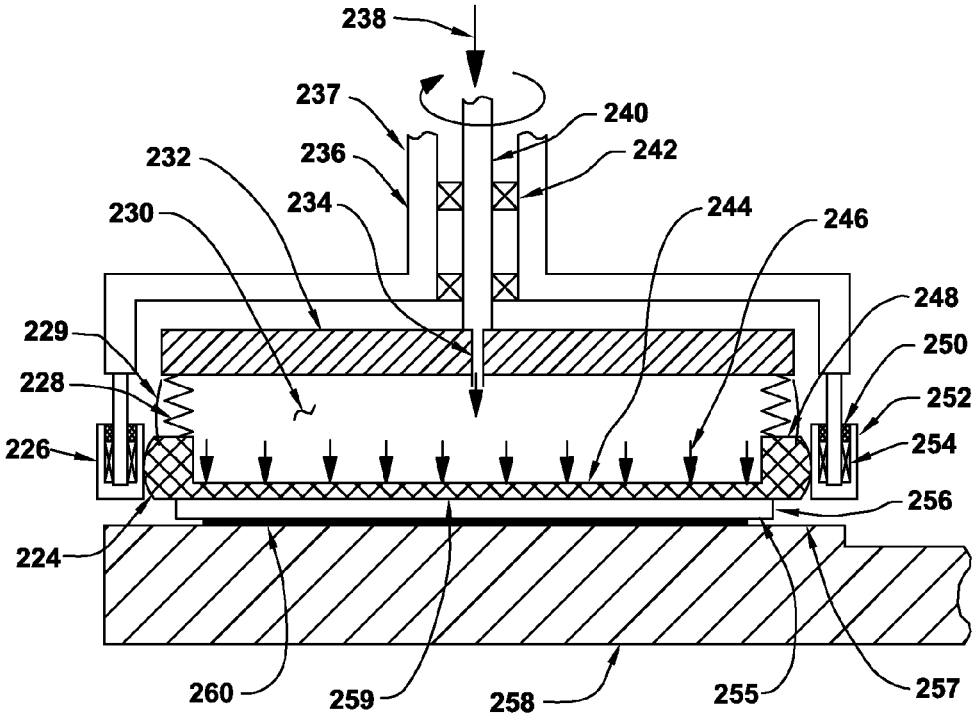
FIG. 9 is a cross section view of a bellows driven carrier with a flexible wafer carrier rotor.

FIG. 9 is a cross section view of a bellows driven floating workpiece carrier with a flexible wafer carrier rotor. A stationary workpiece carrier head 237 has a flat-surfaced workpiece 256 that is attached to a floating workpiece carrier rotor 248 that is rotationally driven by a flexible bellows device 228 that is attached to a drive plate 232. The nominally-horizontal drive plate 232 is attached to a hollow drive shaft 240 having a rotation axis that is supported by bearings 242 that are supported by a stationary carrier housing 236 where the carrier housing 236 can be raised and lowered in a vertical direction. The flexible bellows device 228 that is attached to the drive plate 232 is also attached to the workpiece carrier rotor 248 that is rotationally driven by the flexible bellows device 228. The workpiece carrier rotor 248 has a central flexible bottom portion 259 and has an outer periphery 224 that has a spherical shape which allows the workpiece carrier rotor 248 outer periphery 224 to remain in contact with stationary roller idlers 252 when the rotating carrier rotor 248 is tilted.

The workpiece carrier rotor 248 has a rotation axis that is coincident with the hollow drive shaft 240 rotation axis to avoid interference action of the workpiece carrier rotor 248 with the hollow drive shaft 240 when the hollow drive shaft 240 is rotated. The workpiece 256 carrier rotor 248 rotation axis is positioned to be coincident with the hollow drive shaft 240 rotation axis by the controlled location of the stationary roller idlers 252 that are mounted to the Rolling contact of the workpiece carrier rotor 248 outer periphery 224 with the set of stationary roller idlers 252 that are precisely located at prescribed positions assures that the workpiece carrier rotor 248 rotation axis is coincident with the hollow drive shaft 240 rotation axis. The stationary roller idlers 252 are mounted at positions on the carrier housing 236 where the diameters of the stationary roller idlers 252 and the diameters of the respective workpiece carrier rotors 248 are considered in the design and fabrication of the workpiece carrier head 237 to provide that the workpiece carrier rotor 248 rotation axis is precisely coincident with the hollow drive shaft 240 rotation axis.

If the workpiece carrier rotor 248 rotation axis is positioned to be offset a distance from the hollow drive shaft 240 rotation axis then the flexible bellows device 228 that is attached to both the workpiece carrier rotor 248 and to the drive plate 232 that is attached to the hollow drive shaft 240 will experience an undesirable lateral distortion in a horizontal direction.

Lateral horizontal distortion of the flexible bellows device 228 can produce interference action of the workpiece carrier rotor 248 with the hollow drive shaft 240 when the hollow drive shaft 240 is rotated. Interference action of the workpiece carrier rotor 248 with the hollow drive shaft 240 during rotation of the hollow drive shaft 240 can cause undesirable variations in the speed of rotation of the workpiece 256 that is in abrading contact with the abrasive 260 coating on the rotary platen 258. The variations in the speed of rotation of the workpiece 256 would be periodic with every revolution of the workpiece 256 and would tend to create uneven abrasion patterns on the abraded surface of an expensive workpiece such as a semiconductor wafer, especially when the workpiece 256 is rotated at the high rotational speeds used for high speed lapping or polishing of workpieces 256.

The roller idlers 252 can have a cylindrical peripheral surface 226 or other surface shapes including a "spherical" hour-glass type shape and can have low-friction roller bearings 254 or air bearings 254 and roller idler 252 seals 250 shape and can have low-friction roller bearings 254 or air bearings 254 and roller idler 252 seals 250. The roller idler 252 seals 250 prevent contamination of the low-friction roller bearings 254 or air bearings 254 by abrading debris or coolant water or other fluids or materials that are used in the abrading procedures. The air bearings 254 can provide zero friction and can rotate at very high speeds when the workpiece carrier rotor 248 is rotated at speeds of 3,000 rpm or more that are typically used in high speed flat lapping. Because the diameters of the roller idlers 252 are typically much smaller than the diameters of the workpiece carrier rotors 248 the roller idlers 252 typically have rotational speeds that are much greater than the rotational speeds of the workpiece carrier rotors 248.

Pressurized air or another fluid such as water 238 is supplied through the hollow drive shaft 240 that has a fluid passage 234 that allows pressurized air or another fluid such as water 238 to fill the sealed chamber 230 that is formed by the sealed flexible bellows device 228 that has flexible annular-disk pleats. This controlled fluid 238 pressure is present in the sealed chamber 230 to provide uniform abrading pressure 246 across the flexible full flat top surface 244 portion of the flexible carrier rotor 248 where uniform abrading pressure 246 pressure is directly transferred to the workpiece 256 abraded surface 255 that is in abrading contact with the abrasive 260 coating on the rotary platen 258.

The bellows device 228 annular-disk pleats that are joined together at their inside-diameter and outside-diameter peripheral edges allow the bellows device 228 to act as a spring device which can flex vertically with little friction and to have small deflection stiffness in a vertical direction but provides substantial stiffness in a horizontal direction. However, the horizontal-direction stiffness of the bellows device 228 annular-disk pleats does allow a small amount of misalignment to occur between the rotation axis of the drive shaft 240 and the center of rotation of the workpiece carrier rotor 248. The bellows device 228 pleats are very stiff torsionally due to their near-flat mutually edge-joined annular-disk pleat-section members that are nominally horizontal which allows the bellows device 228 to have substantial tensional stiffness for driving the rotation of the workpiece carrier rotor 248. These types of lightweight bellows devices 228 are often used as zero-backlash but flexible shaft drives for machine tool devices.

The workpiece carrier rotor 248 and the flat-surfaced workpiece 256 such as a semiconductor wafer is allowed to be tilted from a horizontal position when they are stationary or rotated by the flexing action provided by the bellows devices 228 that can be operated at very high rotational speeds. The bellows device 228 pleats can be constructed from corrosion-resistant metals such as stainless steel or from polymers such as polyester.

When the flat-surfaced workpiece 256 and the workpiece carrier rotor 248 are subjected to abrading friction forces that are parallel to the abraded surface 255 of the workpieces 256, these abrading friction forces are resisted by the workpiece carrier rotor 248 as it contacts the multiple idlers 252 that are located around the outer periphery of the workpiece carrier rotor 248. The circular drive plate 232 has an outer periphery 224 spherical shape which allows the workpiece carrier rotor 248 outer periphery 224 to remain in contact with the cylindrical-surfaced roller idlers 252 when the rotating carrier rotor 248 is tilted where the stationary-position surfaced roller idlers 252 that are spaced around the outer periphery of the workpiece carrier rotor 248 act together as a centering device that controls the center of rotation of the workpiece carrier rotor 248 as it rotates.

The circular drive plate 232 outer periphery 224 spherical shape provides that the center of rotation of the workpiece carrier rotor 248 remains aligned with the rotational axis of drive shaft 240 when the workpiece carrier rotor 248 is tilted as it rotates. The workpiece carrier rotor 248 can be tilted due to numerous causes including: flat-surfaced workpiece 256 that have non-parallel opposed surfaces; misalignment of components of the stationary workpiece carrier head 237; misalignment of other components of the abrading machine (not shown); a platen 258 that has an abrading surface 257 that is not flat.

A flexible annular band 229 that is impervious to water, abrading fluids and abrading debris that is preferably constructed from a flexible elastomer or polymer material is attached to the circular drive plate 232 and to the workpiece rotor 248 and which surrounds the outer diameter of the bellows device 228 pleats during to prevent contamination of the bellows device 228 pleats during the abrading procedures.

Figure 10:
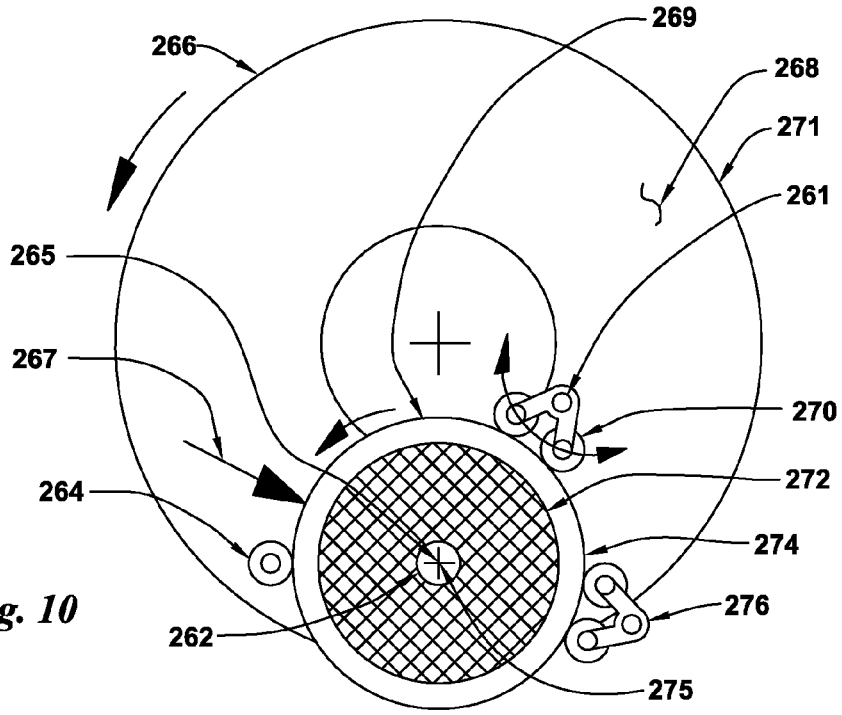
FIG. 10 is a top view of a bellows driven floating carrier that is supported by idlers.

FIG. 10 is a top view of a bellows driven floating workpiece carrier that is supported by idlers. A stationary workpiece carrier head (not shown) has a flat-surfaced workpiece 272 that is attached to a floating workpiece carrier rotor 274 that is rotationally driven by a flexible bellows device (not shown) that is driven by a rotary drive shaft 262 that is attached to the stationary workpiece carrier head. The floating workpiece cylindrical-shaped carrier rotor 274 having a carrier rotor outer diameter 269 is in rolling-contact with three stationary-position rotatable roller idlers 264, 270 that create and maintain the center of rotation 265 of the carrier rotor 274 as it rotates and is subjected to abrading forces 267. The center of rotation 265 of the carrier rotor 274 must be coincident with the axis of rotation 275 of the carrier rotor 274 hollow drive shaft (not shown). An abrasive disk 271 that has an annular band of abrasive 268 is attached to a rotating platen 266. A dual set of idlers 270 is mounted on a pivot arm 276 having a pivot arm 276 rotation center that allows both idlers 270 to contact the outer periphery of the carrier rotor 274 where both idlers 270 share the restraining force load on the carrier rotor that is imposed by the abrading force 267 on the workpiece 272 that is transmitted to the carrier rotor 274 because the workpiece 272 is attached to the carrier rotor 274.

Figure 11:
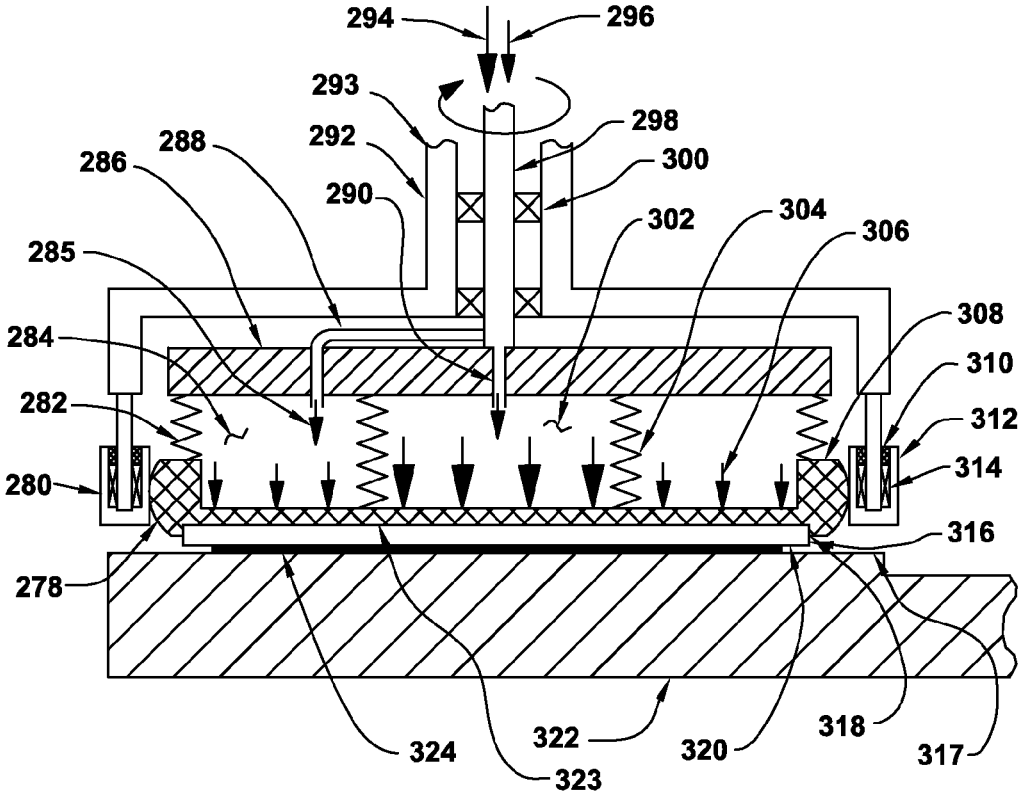
FIG. 11 is a cross section view of a bellows driven floating carrier with multiple bellows.

FIG. 11 is a cross section view of a bellows driven floating workpiece carrier with multiple bellows. A stationary workpiece carrier head 293 has a flat-surfaced workpiece 316 that is attached to a floating workpiece carrier rotor 308 that is rotationally driven by a flexible bellows device 282 that is attached to a drive plate 286. The nominally-horizontal drive plate 286 is attached to a hollow drive shaft 298 having a rotation axis that is supported by bearings 300 that are supported by a stationary carrier housing 292 where the carrier housing 292 can be raised and lowered in a vertical direction. The flexible bellows device 282 that is attached to the drive plate 286 is also attached to the workpiece carrier rotor 308 that is rotationally driven by the flexible bellows device 282. The workpiece carrier rotor 308 has a central flexible bottom portion 323 and has an outer periphery 278 that has a spherical shape which allows the workpiece carrier rotor 308 outer periphery 278 to remain in contact with stationary roller idlers 312 when the rotating carrier rotor 308 is tilted.

The workpiece carrier rotor 308 has a rotation axis that is coincident with the hollow drive shaft 298 rotation axis to avoid interference action of the workpiece carrier rotor 308 with the hollow drive shaft 298 when the hollow drive shaft 298 is rotated. The workpiece 316 carrier rotor 308 rotation axis is positioned to be coincident with the hollow drive shaft 298 rotation axis by the controlled location of the stationary roller idlers 312 that are mounted to the Rolling contact of the workpiece carrier rotor 308 outer periphery 278 with the set of stationary roller idlers 312 that are precisely located at prescribed positions assures that the workpiece carrier rotor 308 rotation axis is coincident with the hollow drive shaft 298 rotation axis. The stationary roller idlers 312 are mounted at positions on the carrier housing 292 where the diameters of the stationary roller idlers 312 and the diameters of the respective workpiece carrier rotors 308 are considered in the design and fabrication of the workpiece carrier head 293 to provide that the workpiece carrier rotor 308 rotation axis is precisely coincident with the hollow drive shaft 298 rotation axis.

If the workpiece carrier rotor 308 rotation axis is positioned to be offset a distance from the hollow drive shaft 298 rotation axis then the flexible bellows device 282 that is attached to both the workpiece carrier rotor 308 and to the drive plate 286 that is attached to the hollow drive shaft 298 will experience an undesirable lateral distortion in a horizontal direction.

Lateral horizontal distortion of the flexible bellows device 282 can produce interference action of the workpiece carrier rotor 308 with the hollow drive shaft 298 when the hollow drive shaft 298 is rotated. Interference action of the workpiece carrier rotor 308 with the hollow drive shaft 298 during rotation of the hollow drive shaft 298 can cause undesirable variations in the speed of rotation of the workpiece 316 that is in abrading contact with the abrasive 324 coating on the rotary platen 322. The variations in the speed of rotation of the workpiece 316 would be periodic with every revolution of the workpiece 316 and would tend to create uneven abrasion patterns on the abraded surface of an expensive workpiece such as a semiconductor wafer, especially when the workpiece 316 is rotated at the high rotational speeds used for high speed lapping or polishing of workpieces 316.

The roller idlers 312 can have a cylindrical peripheral surface 280 or other surface shapes including a "spherical" hour-glass type shape and can have low-friction roller bearings 314 or air bearings 314 and roller idler 312 seals 310 shape and can have low-friction roller bearings 314 or air bearings 314 and roller idler 312 seals 310. The roller idler 312 seals 310 prevent contamination of the low-friction roller bearings 314 or air bearings 314 by abrading debris or coolant water or other fluids or materials that are used in the abrading procedures. The air bearings 314 can provide zero friction and can rotate at very high speeds when the workpiece carrier rotor 308 is rotated at speeds of 3,000 rpm or more that are typically used in high speed flat lapping. Because the diameters of the roller idlers 312 are typically much smaller than the diameters of the workpiece carrier rotors 308 the roller idlers 312 typically have rotational speeds that are much greater than the rotational speeds of the workpiece carrier rotors 308.

Pressurized air or another fluid such as water 296 is supplied through the hollow drive shaft 298 that has a fluid passage 290 that allows pressurized air or another fluid such as water 296 to fill the sealed chamber 284 that is formed by the sealed flexible bellows device 282 that has flexible annular-disk pleats. This controlled fluid 296 pressure is present in the sealed chamber 284 to provide uniform abrading pressure 306 across the flexible full flat top surface 244 portion of the flexible carrier rotor 308 where uniform abrading pressure 306 pressure is directly transferred to the workpiece 316 abraded surface 320 that is in abrading contact with the abrasive 324 coating on the rotary platen 322.

The bellows device 282 annular-disk pleats that are joined together at their inside-diameter and outside-diameter peripheral edges allow the bellows device 282 to act as a spring device which can flex vertically with little friction and to have small deflection stiffness in a vertical direction but provides substantial stiffness in a horizontal direction. However, the horizontal-direction stiffness of the bellows device 282 annular-disk pleats does allow a small amount of misalignment to occur between the rotation axis of the drive shaft 298 and the center of rotation of the workpiece carrier rotor 308. The bellows device 282 pleats are very stiff torsionally due to their near-flat mutually edge-joined annular-disk pleat-section members that are nominally horizontal which allows the bellows device 282 to have substantial tensional stiffness for driving the rotation of the workpiece carrier rotor 308. These types of lightweight bellows devices 282 are often used as zero-backlash but flexible shaft drives for machine tool devices.

The workpiece carrier rotor 308 and the flat-surfaced workpiece 316 such as a semiconductor wafer is allowed to be tilted from a horizontal position when they are stationary or rotated by the flexing action provided by the bellows devices 282 that can be operated at very high rotational speeds. The bellows device 282 pleats can be constructed from corrosion-resistant metals such as stainless steel or from polymers such as polyester.

When the flat-surfaced workpiece 316 and the workpiece carrier rotor 308 are subjected to abrading friction forces that are parallel to the abraded surface 320 of the workpieces 316, these abrading friction forces are resisted by the workpiece carrier rotor 308 as it contacts the multiple idlers 312 that are located around the outer periphery of the workpiece carrier rotor 308. The circular drive plate 286 has an outer periphery 278 spherical shape which allows the workpiece carrier rotor 308 outer periphery 278 to remain in contact with the cylindrical-surfaced roller idlers 312 when the rotating carrier rotor 308 is tilted where the stationary-position surfaced roller idlers 312 that are spaced around the outer periphery of the workpiece carrier rotor 308 act together as a centering device that controls the center of rotation of the workpiece carrier rotor 308 as it rotates.

The circular drive plate 286 outer periphery 278 spherical shape provides that the center of rotation of the workpiece carrier rotor 308 remains aligned with the rotational axis of drive shaft 298 when the workpiece carrier rotor 308 is tilted as it rotates. The workpiece carrier rotor 308 can be tilted due to numerous causes including: flat-surfaced workpiece 316 that have non-parallel opposed surfaces; misalignment of components of the stationary workpiece carrier head 293; misalignment of other components of the abrading machine (not shown); a platen 322 that has an abrading surface 317 that is not flat.

A flexible annular band 229 that is impervious to water, abrading fluids and abrading debris that is preferably constructed from a flexible elastomer or polymer material is attached to the circular drive plate 286 and to the workpiece rotor 308 and which surrounds the outer diameter of the bellows device 282 pleats during to prevent contamination of the bellows device 282 pleats during the abrading procedures.

Multiple the flexible bellows devices 304 can be used in addition to the flexible bellows device 282 where independent sealed pressure chambers 302 can formed that have annular or circular shapes. Independent fluid pressure 285 sources can supply fluid pressure 285 from the hollow drive shaft 298 to flexible or rigid fluid tubes 288 or passageways (not shown) within the circular drive plate 286 to apply these independent pressures 285 to the independent portions of the workpiece carrier rotor 308 central flexible bottom portion 323. These independent fluid pressure 285 zones that are located in the independent fluid chambers 284, 302 provide localized out-of-plane distortion of the workpiece carrier rotor 308 central flexible bottom portion 323 to provide independently-controlled abrading pressure to localized portions of the abraded surface 320 of the workpieces 316.

Figure 12:
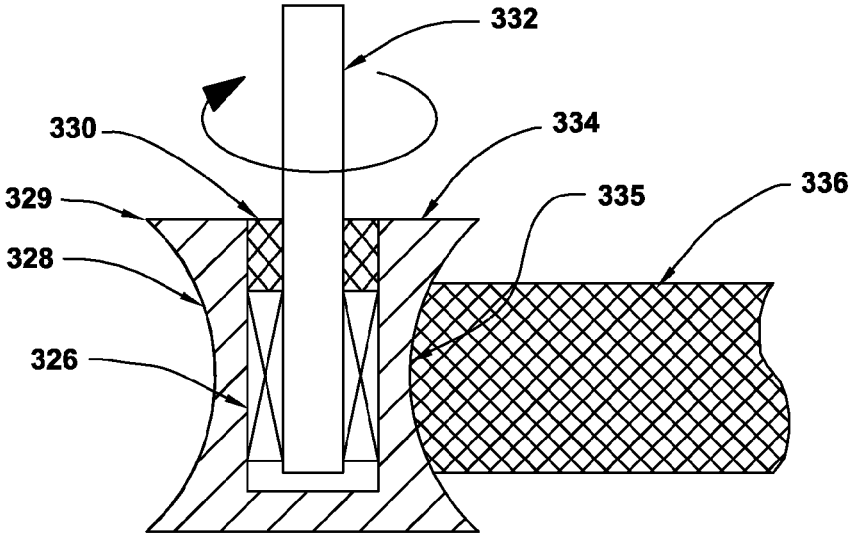
FIG. 12 is a cross section view of a floating workpiece carrier supported laterally by idlers.

FIG. 12 is a cross section view of a floating workpiece carrier having a spherical surface that is supported laterally by idlers having a matching spherical surface. A floating workpiece carrier rotor 336 that has an outer periphery 335 that has a spherical shape which allows the rotating workpiece carrier rotor 336 outer periphery 335 to remain in contact with stationary roller idlers 334 that have a matching spherical shape 328 when the rotating carrier rotor 336 is tilted. The rotatable stationary roller idlers 334 have a vertical stationary support shaft 332 that supports idler roller bearings 326 or air bearings 326 that support the idler 334 idler shell 329 where the stationary spherical-shaped idlers 334 support the carrier rotor 336 in a horizontal direction but allow the rotating carrier rotor 336 to be tilted.

The abrading machine workpiece substrate carrier apparatus and processes to use it are described here. In one embodiment, an abrading machine workpiece substrate carrier is described comprising:

a) a movable nominally-horizontal stationary-positioned carrier housing having an outer periphery and an outer periphery area that is nominally-horizontal and is adjacent to the stationary-positioned carrier housing outer periphery and having rotary bearings that support a vertical hollow rotatable carrier drive shaft having a carrier drive shaft cross-section and a carrier drive shaft length and a carrier drive shaft axis of rotation that is concentric to the carrier drive shaft cross-section and extends along the length of the carrier drive shaft where the carrier drive shaft is fixed vertically to the stationary-positioned carrier housing where the stationary-positioned carrier housing can be moved in a vertical direction;

b) a circular rotatable drive plate having a rotatable drive plate outer diameter, a rotatable drive plate top surface and an opposed rotatable drive plate bottom surface where both the rotatable drive plate top surface and the rotatable drive plate bottom surface are nominally horizontal and where the rotatable drive plate has a rotation axis that is perpendicular to the rotatable drive plate top surface and is located at the center of the rotatable drive plate top surface wherein the rotatable drive plate top surface is attached to and is supported by the carrier drive shaft where the carrier drive shaft axis of rotation is concentric with the rotatable drive plate rotation axis;

c) a rotatable bellows spring device having multiple annular rings of flat-surfaced metal or polymers having annular ring outer diameters and annular ring inside diameters where adjacent annular rings are joined together at their outer diameters and adjacent annular rings are joined together at their inner diameters to form the rotatable bellows spring device wherein the multiple individual annular rings are nominally horizontal and where the individual annular rings are flexible in a vertical direction and where the rotatable bellows spring device has a rotatable bellows spring device top annular ring and a rotatable bellows spring device bottom annular ring and where the rotatable bellows spring device has a nominally-vertical axis of rotation that is perpendicular to the rotatable bellows spring device nominally-horizontal top annular ring and the rotatable bellows spring device axis of rotation is located at the center of the rotatable bellows spring device top annular ring wherein the rotatable bellows spring device can flex in a vertical direction;

d) where the rotatable bellows spring device individual annular ring outer diameters are approximately the same and where the rotatable bellows spring device individual annular ring outer diameters are approximately the same as the rotatable drive plate outer diameter wherein the rotatable bellows spring device top annular ring is attached to the rotatable drive plate bottom surface where the rotatable bellows spring device axis of rotation is nominally-coincident with the rotatable drive plate rotation axis;

e) a circular rotatable workpiece carrier plate having a rotatable workpiece carrier plate top surface and an opposed rotatable workpiece carrier plate flat bottom surface where both the rotatable workpiece carrier plate top surface and the rotatable workpiece carrier plate bottom surface are nominally horizontal and where the rotatable workpiece carrier plate has a rotation axis that is perpendicular to the rotatable workpiece carrier plate top surface and is located at the center of the rotatable workpiece carrier plate top surface wherein the rotatable workpiece carrier plate has a rotatable workpiece carrier plate outer diameter that is approximately the same as the rotatable bellows spring device individual annular ring outer diameters where the rotatable workpiece carrier plate has a rotatable workpiece carrier plate thickness and a rotatable workpiece carrier plate outer periphery surface that is located at the rotatable workpiece carrier plate outer diameter and extends from the rotatable workpiece carrier plate top surface to the rotatable workpiece carrier plate flat bottom surface;

f) where the rotatable bellows spring device bottom annular ring is attached to the rotatable workpiece carrier plate top surface wherein the rotatable bellows spring device axis of rotation is nominally-coincident with the rotatable workpiece carrier plate rotation axis;

g) at least two roller idlers having respective stationary nominally-vertical roller idler shafts having respective stationary roller idler shaft lengths wherein the respective at least two stationary roller idler shafts are attached to the stationary-positioned carrier housing outer periphery in the stationary-positioned carrier housing outer periphery area where the respective at least two stationary roller idler shafts support respective roller idler bearings that support respective rotatable roller idler shells where the respective rotatable roller idler outer shells have a roller idler outer shell periphery and a roller idler outer shell periphery surface area that is nominally-vertical where the respective rotatable roller idler outer shells rotate about a rotation axis that is concentric with the roller idler shafts and extend along the respective roller idler shafts lengths where the respective rotation axes of the respective roller idler shafts are nominally-vertical;

h) where the at least two multiple roller idlers are attached to the stationary-positioned carrier housing outer periphery area around the stationary-positioned carrier housing outer periphery where the at least two respective rotatable roller idler outer shells periphery surface areas are positioned in contact with the rotatable workpiece carrier plate outer diameter rotatable workpiece carrier plate outer periphery surface wherein the at least two multiple roller idlers can be in rolling contact with the rotatable workpiece carrier plate outer periphery surface as the rotatable workpiece carrier plate is rotated and where the at least two multiple roller idlers can maintain the rotatable workpiece carrier plate rotation axis to be concentric with the carrier drive shaft axis of rotation when the rotatable workpiece carrier plate is rotated;

i) wherein at least one workpiece having parallel opposed flat workpiece top surfaces and flat workpiece bottom surfaces are attached to the rotatable workpiece carrier plate flat bottom surface where the at least one workpiece top surface is attached to the rotatable workpiece carrier plate flat bottom surface;

j) a rotatable abrading platen having a flat abrasive coated abrading surface that is nominally horizontal;

k) wherein the stationary-positioned carrier housing can be moved vertically to position the flat workpiece bottom surface into flat-surfaced abrading contact with the rotatable abrading platen abrading surface and wherein the stationary-positioned carrier housing can be moved vertically to move the flat workpiece bottom surface from flat-surfaced abrading contact with the rotatable abrading platen abrading surface.

In another embodiment, the apparatus is described where the rotatable bellows spring device top annular ring is attached to the rotatable drive plate bottom surface and where the spring device bottom annular ring is attached to the rotatable workpiece carrier plate top surface wherein a sealed enclosed pressure chamber is formed in the internal volume that is contained by the rotatable bellows spring device, the rotatable drive plate bottom surface and the rotatable workpiece carrier plate top surface wherein the rotatable bellows spring device, the rotatable drive plate bottom surface and the rotatable workpiece carrier plate top surface where the rotatable bellows spring device multiple individual annular ring joints are pressure and vacuum sealed and where the rotatable drive attached to the rotatable drive plate bottom surface and where the rotatable bellows plate bottom surface is pressure and vacuum sealed and where the rotatable workpiece carrier plate top surface is pressure and vacuum sealed where controlled-pressure air or controlled-pressure fluid or vacuum can be introduced into the sealed enclosed pressure chamber through a fluid passageway that connects the hollow rotatable carrier drive shaft to the enclosed pressure chamber.

This apparatus is also described where the controlled-pressure air or controlled-pressure fluid that exists in the sealed enclosed pressure chamber can act on the rotatable workpiece carrier plate top surface where the controlled-pressure air or controlled-pressure fluid pressure is transmitted through the rotatable workpiece carrier plate thickness wherein this controlled-pressure air or controlled-pressure fluid pressure is transmitted to the at least one workpiece that is attached to the rotatable workpiece carrier plate wherein the controlled-pressure air or controlled-pressure fluid provides an abrading pressure which acts uniformly on the at least one workpiece and forces the at least one flat workpiece bottom surface into flat-surfaced abrading contact with the rotatable abrading platen abrading surface when the rotatable bellows spring device is flexed in a vertical direction by changing the pressure of the controlled-pressure air or controlled-pressure fluid in the sealed enclosed pressure chamber.

Further, this apparatus is described where controlled vacuum is applied to the sealed enclosed pressure chamber where the controlled vacuum negative pressure acts on the rotatable workpiece carrier plate top surface and compresses the rotatable bellows spring device which is flexed in a vertical direction by applying the controlled vacuum negative pressure in the sealed enclosed pressure chamber wherein the rotatable workpiece carrier plate is raised away from the rotatable abrading platen abrading surface.

In another embodiment, the abrading machine workpiece substrate carrier apparatus is described where a flexible fluid or vacuum passageway tube is attached to the hollow rotatable carrier drive shaft and is routed to fluid passageways that are connected to fluid port holes in the rotatable workpiece carrier plate flat bottom surface where vacuum can be applied through the flexible fluid or vacuum passageway tube to attach the flat-surfaced at least one workpiece to the rotatable workpiece carrier plate flat bottom surface or controlled-pressure air or controlled-pressure fluid can be applied through the flexible fluid or vacuum passageway tube to separate the attached flat-surfaced at least one workpiece from the rotatable workpiece carrier plate flat bottom surface.

In addition, this apparatus is described where a flexible annular debris band that is impervious to water, abrading fluids and abrading debris is constructed from a flexible elastomer or polymer material where the flexible annular debris band is attached to the rotatable drive plate and is attached to the rotatable workpiece carrier plate where the flexible annular debris band surrounds the outer diameter of the rotatable bellows spring device individual annular ring outer diameters to prevent contamination of the rotatable bellows spring device individual annular rings by water, abrading fluids and abrading debris.

Also, the apparatus is described where the rotatable workpiece carrier plate is flexible in a vertical direction but is substantially rigid in a horizontal direction wherein portions of the rotatable workpiece carrier plate flat bottom surface can be distorted out-of-plane by the controlled-pressure air or controlled-pressure fluid that exists in the sealed enclosed pressure chamber which acts on the rotatable workpiece carrier plate top surface where the controlled-pressure air or controlled-pressure fluid pressure is applied to the flexible rotatable workpiece carrier plate wherein the flexible rotatable workpiece carrier plate flat bottom surface can assume a non-flat shape.

Further, this apparatus is described where multiple rotatable bellows spring devices are positioned to be concentric with each other to form independent annular or circular rotatable bellows spring device's sealed enclosed pressure chambers and where sealed enclosed pressure chambers are formed between adjacent sealed enclosed pressure chambers wherein each independent sealed rotatable bellows spring device sealed enclosed pressure chamber has an independent controlled-pressure air or controlled-pressure fluid source to provide independent controlled-pressure air or controlled-pressure fluid pressures to the respective rotatable bellows spring device's sealed enclosed pressure chambers wherein the flexible rotatable workpiece carrier plate bottom surface assumes a non-flat shapes at the location of each independent rotatable bellows spring device's sealed enclosed pressure chamber wherein the respective rotatable bellows spring device's sealed enclosed pressure chambers apply independently controlled abrading pressures to the portions of the at least one workpiece abraded surface that is positioned on the flexible rotatable workpiece carrier plate at the location of the respective rotatable bellows spring device's sealed enclosed pressure chambers.

Also, the rotatable workpiece carrier plate outer diameter outer periphery surface can have a spherical shape. In addition, the rotatable workpiece carrier plate outer diameter outer periphery surface has a spherical shape where the spherical center of the rotatable workpiece carrier plate outer diameter outer periphery surface spherical shape is located at or near to the abraded surface of the at least one workpiece and where the rotatable roller idler outer shells periphery surface areas are spherical-shaped surfaces where the centers of the rotatable roller idler spherical shape's spheres are respectively located at or near to the abraded surface of the at least one workpiece wherein the rotatable workpiece carrier plate can rotate with spherical-action about the spherical center of the rotatable workpiece carrier plate outer diameter outer periphery surface spherical shape sphere.

Processes to use the abrading machine workpiece substrate carrier apparatus are described here. In one embodiment, a process of providing abrading workpieces using an abrading machine workpiece substrate carrier apparatus is described comprising:

a) providing a movable nominally-horizontal stationary-positioned carrier housing having an outer periphery and an outer periphery area that is nominally-horizontal and is adjacent to the stationary-positioned carrier housing outer periphery and having rotary bearings that support a vertical hollow rotatable carrier drive shaft having a carrier drive shaft cross-section and a carrier drive shaft length and a carrier drive shaft axis of rotation that is concentric to the carrier drive shaft cross-section and extends along the length of the carrier drive shaft where the carrier drive shaft is fixed vertically to the stationary-positioned carrier housing where the stationary-positioned carrier housing can be moved in a vertical direction;

b) providing a circular rotatable drive plate having a rotatable drive plate outer diameter, a rotatable drive plate top surface and an opposed rotatable drive plate bottom surface where both the rotatable drive plate top surface and the rotatable drive plate bottom surface are nominally horizontal and where the rotatable drive plate has a rotation axis that is perpendicular to the rotatable drive plate top surface and is located at the center of the rotatable drive plate top surface wherein the rotatable drive plate top surface is attached to and is supported by the carrier drive shaft where the carrier drive shaft axis of rotation is concentric with the rotatable drive plate rotation axis;

c) providing a rotatable bellows spring device having multiple annular rings of flat-surfaced metal or polymers having annular ring outer diameters and annular ring inside diameters where adjacent annular rings are joined together at their outer diameters and adjacent annular rings are joined together at their inner diameters to form the rotatable bellows spring device wherein the multiple individual annular rings are nominally horizontal and where the individual annular rings are flexible in a vertical direction and where the rotatable bellows spring device has a rotatable bellows spring device top annular ring and a rotatable bellows spring device bottom annular ring and where the rotatable bellows spring device has a nominally-vertical axis of rotation that is perpendicular to the rotatable bellows spring device nominally-horizontal top annular ring and the rotatable bellows spring device axis of rotation is located at the center of the rotatable bellows spring device top annular ring wherein the rotatable bellows spring device can flex in a vertical direction;

d) providing that the rotatable bellows spring device individual annular ring outer diameters are approximately the same and providing that the rotatable bellows spring device individual annular ring outer diameters are approximately the same as the rotatable drive plate outer diameter wherein the rotatable bellows spring device top annular ring is attached to the rotatable drive plate bottom surface where the rotatable bellows spring device axis of rotation is nominally-coincident with the rotatable drive plate rotation axis;

e) providing a circular rotatable workpiece carrier plate having a rotatable workpiece carrier plate top surface and an opposed rotatable workpiece carrier plate flat bottom surface where both the rotatable workpiece carrier plate top surface and the rotatable workpiece carrier plate bottom surface are nominally horizontal and where the rotatable workpiece carrier plate has a rotation axis that is perpendicular to the rotatable workpiece carrier plate top surface and is located at the center of the rotatable workpiece carrier plate top surface wherein the rotatable workpiece carrier plate has a rotatable workpiece carrier plate outer diameter that is approximately the same as the rotatable bellows spring device individual annular ring outer diameters where the rotatable workpiece carrier plate has a rotatable workpiece carrier plate thickness and a rotatable workpiece carrier plate outer periphery surface that is located at the rotatable workpiece carrier plate outer diameter and extends from the rotatable workpiece carrier plate top surface to the rotatable workpiece carrier plate flat bottom surface;

f) attaching the rotatable bellows spring device bottom annular ring to the rotatable workpiece carrier plate top surface wherein the rotatable bellows spring device axis of rotation is nominally-coincident with the rotatable workpiece carrier plate rotation axis;

g) providing at least two roller idlers having respective stationary nominally-vertical roller idler shafts having respective stationary roller idler shaft lengths wherein the respective at least two stationary roller idler shafts are attached to the stationary-positioned carrier housing outer periphery in the stationary-positioned carrier housing outer periphery area where the respective at least two stationary roller idler shafts support respective roller idler bearings that support respective rotatable roller idler shells where the respective rotatable roller idler outer shells have a roller idler outer shell periphery and a roller idler outer shell periphery surface area that is nominally-vertical where the respective rotatable roller idler outer shells rotate about a rotation axis that is concentric with the roller idler shafts and extend along the respective roller idler shafts lengths where the respective rotation axes of the respective roller idler shafts are nominally-vertical;

h) attaching the at least two multiple roller idlers to the stationary-positioned carrier housing outer periphery area around the stationary-positioned carrier housing outer periphery where the at least two respective rotatable roller idler outer shells periphery surface areas are positioned in contact with the rotatable workpiece carrier plate outer diameter rotatable workpiece carrier plate outer periphery surface wherein the at least two multiple roller idlers can be in rolling contact with the rotatable workpiece carrier plate outer periphery surface as the rotatable workpiece carrier plate is rotated and where the at least two multiple roller idlers can maintain the rotatable workpiece carrier plate rotation axis to be concentric with the carrier drive shaft axis of rotation when the rotatable workpiece carrier plate is rotated;

i) providing at least one workpiece having parallel opposed flat workpiece top surfaces and flat workpiece bottom surfaces that are attached to the rotatable workpiece carrier plate flat bottom surface where the at least one workpiece top surface is attached to the rotatable workpiece carrier plate flat bottom surface;

j) providing a rotatable abrading platen having a flat abrasive coated abrading surface that is nominally horizontal;

k) providing that the stationary-positioned carrier housing can be moved vertically to position the flat workpiece bottom surface into flat-surfaced abrading contact with the rotatable abrading platen abrading surface and providing that the stationary-positioned carrier housing can be moved vertically to move the flat workpiece bottom surface from flat-surfaced abrading contact with the rotatable abrading platen abrading surface.

In another embodiment of the process, the rotatable bellows spring device top annular ring is attached to the rotatable drive plate bottom surface and where the spring device bottom annular ring is attached to the rotatable workpiece carrier plate top surface wherein a sealed enclosed pressure chamber is formed in the internal volume that is contained by the rotatable bellows spring device, the rotatable drive plate bottom surface and the rotatable workpiece carrier plate top surface wherein the rotatable bellows spring device, the rotatable drive plate bottom surface and the rotatable workpiece carrier plate top surface where the rotatable bellows spring device multiple individual annular ring joints are pressure and vacuum sealed and where the rotatable drive attached to the rotatable drive plate bottom surface and where the rotatable bellows plate bottom surface is pressure and vacuum sealed and where the rotatable workpiece carrier plate top surface is pressure and vacuum sealed where controlled-pressure air or controlled-pressure fluid or vacuum are introduced into the sealed enclosed pressure chamber through a fluid passageway that connects the hollow rotatable carrier drive shaft to the enclosed pressure chamber.

In a further embodiment, the controlled-pressure air or controlled-pressure fluid that exists in the sealed enclosed pressure chamber acts on the rotatable workpiece carrier plate top surface where the controlled-pressure air or controlled-pressure fluid pressure is transmitted through the rotatable workpiece carrier plate thickness wherein this controlled-pressure air or controlled-pressure fluid pressure is transmitted to the at least one workpiece that is attached to the rotatable workpiece carrier plate wherein the controlled-pressure air or controlled-pressure fluid provides an abrading pressure which acts uniformly on the at least one workpiece and forces the at least one flat workpiece bottom surface into flat-surfaced abrading contact with the rotatable abrading platen abrading surface when the rotatable bellows spring device is flexed in a vertical direction by changing the pressure of the controlled-pressure air or controlled-pressure fluid in the sealed enclosed pressure chamber.

In this process, controlled vacuum is applied to the sealed enclosed pressure chamber where the controlled vacuum negative pressure acts on the rotatable workpiece carrier plate top surface and compresses the rotatable bellows spring device which is flexed in a vertical direction by applying the controlled vacuum negative pressure in the sealed enclosed pressure chamber wherein the rotatable workpiece carrier plate is raised away from the rotatable abrading platen abrading surface.

Further, a description is given where a flexible fluid or vacuum passageway tube is attached to the hollow rotatable carrier drive shaft and is routed to fluid passageways that are connected to fluid port holes in the rotatable workpiece carrier plate flat bottom surface where vacuum is applied through the flexible fluid or vacuum passageway tube to attach flat-surfaced the at least one workpiece to the rotatable workpiece carrier plate flat bottom surface or controlled-pressure air or controlled-pressure fluid is applied through the flexible fluid or vacuum passageway tube to separate the attached flat-surfaced at least one workpiece from the rotatable workpiece carrier plate flat bottom surface.

In addition, the process is described where a flexible annular debris band that is impervious to water, abrading fluids and abrading debris is constructed from a flexible elastomer or polymer material where the flexible annular debris band is attached to the rotatable drive plate and is attached to the rotatable workpiece carrier plate where the flexible annular debris band surrounds the outer diameter of the rotatable bellows spring device individual annular ring outer diameters to prevent contamination of the rotatable bellows spring device individual annular rings by water, abrading fluids and abrading debris.

Also, in another embodiment of the process, a rotatable workpiece carrier plate is provided that is flexible in a vertical direction but is substantially rigid in a horizontal direction wherein portions of the rotatable workpiece carrier plate flat bottom surface can be distorted out-of-plane by the controlled-pressure air or controlled-pressure fluid that exists in the sealed enclosed pressure chamber which acts on the rotatable workpiece carrier plate top surface where the controlled-pressure air or controlled-pressure fluid pressure is applied to the flexible rotatable workpiece carrier plate wherein the flexible rotatable workpiece carrier plate flat bottom surface can assume a non-flat shape.

In addition, in this process, multiple rotatable bellows spring devices are provided that are positioned to be concentric with each other to form independent annular or circular rotatable bellows spring device's sealed enclosed pressure chambers sealed enclosed pressure chambers and where sealed enclosed pressure chambers are formed between adjacent sealed enclosed pressure chambers wherein each independent sealed rotatable bellows spring device sealed enclosed pressure chamber has an independent controlled-pressure air or controlled-pressure fluid source to provide independent controlled-pressure air or controlled-pressure fluid pressures to the respective rotatable bellows spring device's sealed enclosed pressure chambers wherein the flexible rotatable workpiece carrier plate bottom surface assumes a non-flat shapes at the location of each independent rotatable bellows spring device's sealed enclosed pressure chamber wherein the respective rotatable bellows spring device's sealed enclosed pressure chambers apply independently controlled abrading pressures to the portions of the at least one workpiece abraded surface that is positioned on the flexible rotatable workpiece carrier plate at the location of the respective rotatable bellows spring device's sealed enclosed pressure chambers.

Further, in the process, the rotatable workpiece carrier plate outer diameter outer periphery surface has a spherical shape. Further, in the process, the rotatable workpiece carrier plate outer diameter outer periphery surface has a spherical shape where the spherical center of the rotatable workpiece carrier plate outer diameter outer periphery surface spherical shape is located at or near to the abraded surface of the at least one workpiece and where the rotatable roller idler outer shells periphery surface areas are spherical-shaped surfaces where the centers of the rotatable roller idler spherical shape's spheres are respectively located at or near to the abraded surface of the at least one workpiece wherein the rotatable workpiece carrier plate can rotate with spherical-action about the spherical center of the rotatable workpiece carrier plate outer diameter outer periphery surface spherical shape sphere.

What is claimed:

1. An abrading machine workpiece substrate carrier apparatus comprising:

a) a movable, nominally-horizontal, stationary-positioned carrier housing having an outer periphery and an outer periphery area that is nominally-horizontal and is adjacent to the stationary-positioned carrier housing outer periphery, the carrier housing having rotary bearings that support a vertical hollow rotatable carrier drive shaft having i) a carrier drive shaft cross-section, ii) a carrier drive shaft length and iii) a carrier drive shaft axis of rotation that is concentric to the carrier drive shaft cross-section and extends along a length of the carrier drive shaft wherein the carrier drive shaft is fixed vertically to the stationary-positioned carrier housing and wherein the stationary-positioned carrier housing is moveable in a vertical direction;

b) a circular rotatable drive plate having a rotatable drive plate outer diameter, a rotatable drive plate top surface and an opposed rotatable drive plate bottom surface wherein both the rotatable drive plate top surface and the rotatable drive plate bottom surface are nominally horizontal and wherein the rotatable drive plate has a rotation axis that is perpendicular to the rotatable drive plate top surface and is located at the center of the rotatable drive plate top surface, wherein the rotatable drive plate top surface is attached to and is supported by the carrier drive shaft and wherein the carrier drive shaft axis of rotation is concentric with the rotatable drive plate rotation axis;

c) a rotatable bellows spring device having multiple annular rings of flat-surfaced metal or polymers having annular ring outer diameters and annular ring inside diameters where adjacent annular rings are joined together at their outer diameters and adjacent annular rings are joined together at their inner diameters to form the rotatable bellows spring device wherein the multiple individual annular rings are nominally horizontal and where the individual annular rings are flexible in a vertical direction and where the rotatable bellows spring device has a rotatable bellows spring device top annular ring and a rotatable bellows spring device bottom annular ring and where the rotatable bellows spring device has a nominally-vertical axis of rotation that is perpendicular to the rotatable bellows spring device nominally-horizontal top annular ring and the rotatable bellows spring device axis of rotation is located at the center of the rotatable bellows spring device top annular ring wherein the rotatable bellows spring device can flex in a vertical direction;

d) wherein the rotatable bellows spring device individual annular ring outer diameters are approximately the same and wherein the rotatable bellows spring device individual annular ring outer diameters are approximately the same as the rotatable drive plate outer diameter wherein the rotatable bellows spring device top annular ring is attached to the rotatable drive plate bottom surface and wherein the rotatable bellows spring device axis of rotation is nominally-coincident with the rotatable drive plate rotation axis;

e) a circular rotatable workpiece carrier plate having a rotatable workpiece carrier plate top surface and an opposed rotatable workpiece carrier plate flat bottom surface wherein both the rotatable workpiece carrier plate top surface and the rotatable workpiece carrier plate bottom surface are nominally horizontal and wherein the rotatable workpiece carrier plate has a rotation axis that is perpendicular to the rotatable workpiece carrier plate top surface and is located at the center of the rotatable workpiece carrier plate top surface, wherein the rotatable workpiece carrier plate has a rotatable workpiece carrier plate outer diameter that is approximately the same as outer diameters of the rotatable bellows spring device individual annular ring wherein the rotatable workpiece carrier plate has a rotatable workpiece carrier plate thickness and a rotatable workpiece carrier plate outer periphery surface located at the rotatable workpiece carrier plate outer diameter and extends from the rotatable workpiece carrier plate top surface to the rotatable workpiece carrier plate flat bottom surface;

f) the rotatable bellows spring device bottom annular ring is attached to the rotatable workpiece carrier plate top surface and wherein the rotatable bellows spring device axis of rotation is nominally-coincident with the rotatable workpiece carrier plate rotation axis;

g) at least two roller idlers having respective stationary nominally-vertical roller idler shafts having respective stationary roller idler shaft lengths attached to the stationary-positioned carrier housing outer periphery in the stationary-positioned carrier housing outer periphery area, wherein the respective at least two stationary roller idler shafts support respective roller idler bearings that support respective rotatable roller idler shells, and wherein the respective rotatable roller idler outer shells have a roller idler outer shell periphery and a roller idler outer shell periphery surface area that is nominally-vertical and the respective rotatable roller idler outer shells rotate about a rotation axis that is concentric with the roller idler shafts and extend along the respective roller idler shafts lengths, wherein the respective rotation axes of the respective roller idler shafts are nominally-vertical;

h) the at least two multiple roller idlers are attached to the stationary-positioned carrier housing outer periphery area around the stationary-positioned carrier housing outer periphery, the at least two respective rotatable roller idler outer shells periphery surface areas are positioned in contact with the rotatable workpiece carrier plate outer diameter rotatable workpiece carrier plate outer periphery surface, and the at least two multiple roller idlers care in rolling contact with the rotatable workpiece carrier plate outer periphery surface as the rotatable workpiece carrier plate is rotated and the at least two multiple roller idlers maintain the rotatable workpiece carrier plate rotation axis to be concentric with the carrier drive shaft axis of rotation when the rotatable workpiece carrier plate is rotated;

i) wherein at least one workpiece having parallel opposed flat workpiece top surfaces and flat workpiece bottom surfaces are attached to the rotatable workpiece carrier plate flat bottom surface and wherein the at least one workpiece top surface is attached to the rotatable workpiece carrier plate flat bottom surface;

j) a rotatable abrading platen having a flat abrasive coated abrading surface that is nominally horizontal;

k) wherein the stationary-positioned carrier housing is moveable vertically to position the flat workpiece bottom surface into flat-surfaced abrading contact with the rotatable abrading platen abrading surface and the stationary-positioned carrier housing is moveable vertically to move the flat workpiece bottom surface from flat-surfaced abrading contact with the rotatable abrading platen abrading surface.

2. The apparatus of claim 1 where the rotatable bellows spring device top annular ring is attached to the rotatable drive plate bottom surface and the spring device bottom annular ring is attached to the rotatable workpiece carrier plate top surface, wherein a sealed enclosed pressure chamber is formed in an internal volume that is contained by the rotatable bellows spring device, the rotatable drive plate bottom surface and the rotatable workpiece carrier plate top surface, wherein the rotatable bellows spring device, the rotatable drive plate bottom surface, the rotatable workpiece carrier plate top surface and the rotatable bellows spring device multiple individual annular ring joints are pressure and vacuum sealed, wherein the rotatable drive is attached to the rotatable drive plate bottom surface and the rotatable bellows plate bottom surface is pressure and vacuum sealed and where the rotatable workpiece carrier plate top surface is pressure and vacuum sealed, wherein controlled-pressure air or controlled-pressure fluid or controlled-pressure vacuum can be introduced into the sealed enclosed pressure chamber through a fluid passageway connecting the hollow rotatable carrier drive shaft to the enclosed pressure chamber.

3. The apparatus of claim 2 where the controlled-pressure air or controlled-pressure fluid in the sealed enclosed pressure chamber acts on the rotatable workpiece carrier plate top surface where the controlled-pressure air or controlled-pressure fluid pressure is transmitted through the rotatable workpiece carrier plate thickness, wherein this controlled-pressure air or controlled-pressure fluid pressure is transmitted to the at least one workpiece that is attached to the rotatable workpiece carrier plate, wherein the controlled-pressure air or controlled-pressure fluid provides an abrading pressure which acts uniformly on the at least one workpiece and forces the at least one flat workpiece bottom surface into flat-surfaced abrading contact with the rotatable abrading platen abrading surface when the rotatable bellows spring device is flexed in a vertical direction by changing the pressure of the controlled-pressure air or controlled-pressure fluid in the sealed enclosed pressure chamber.

4. The apparatus of claim 2 where controlled vacuum is applied to the sealed enclosed pressure chamber wherein the controlled vacuum negative pressure acts on the rotatable workpiece carrier plate top surface and compresses the rotatable bellows spring device which is flexed in a vertical direction by applying the controlled vacuum negative pressure in the sealed enclosed pressure chamber and the rotatable workpiece carrier plate is raised away from the rotatable abrading platen abrading surface.

5. The apparatus of claim 1 where a flexible fluid or vacuum passageway tube is attached to the hollow rotatable carrier drive shaft and is routed to fluid passageways that are connected to fluid port holes in the rotatable workpiece carrier plate flat bottom surface where i) vacuum can be applied through the flexible fluid or vacuum passageway tube to attach the flat-surfaced at least one workpiece to the rotatable workpiece carrier plate flat bottom surface or ii) controlled-pressure air or controlled-pressure fluid can be applied through the flexible fluid or vacuum passageway tube to separate the attached flat-surfaced at least one workpiece from the rotatable workpiece carrier plate flat bottom surface.

6. The apparatus of claim 1 where a flexible annular debris band that is impervious to water, abrading fluids and abrading debris comprises a flexible elastomer or flexible polymer material where the flexible annular debris band is attached to the rotatable drive plate and to the rotatable workpiece carrier plate, wherein the flexible annular debris band surrounds the outer diameter of the rotatable bellows spring device individual annular ring outer diameters to prevent contamination of the rotatable bellows spring device individual annular rings by water, abrading fluids and abrading debris.

7. The apparatus of claim 3 where the rotatable workpiece carrier plate is flexible in a vertical direction but is substantially rigid in a horizontal direction wherein portions of the rotatable workpiece carrier plate flat bottom surface can be distorted out-of-plane by the controlled-pressure air or controlled-pressure fluid in the sealed enclosed pressure chamber which acts on the rotatable workpiece carrier plate top surface, wherein the controlled-pressure air or controlled-pressure fluid pressure is applied to the flexible rotatable workpiece carrier plate and the flexible rotatable workpiece carrier plate flat bottom surface can assume a non-flat shape.

8. The apparatus of claim 7 where multiple rotatable bellows spring devices are positioned concentric with respect to each other to form independent annular or circular rotatable bellows spring devices' sealed enclosed pressure chambers and where sealed enclosed pressure chambers are formed between adjacent sealed enclosed pressure chambers, wherein each independent sealed rotatable bellows spring device sealed enclosed pressure chamber has an independent controlled-pressure air or controlled-pressure fluid source to provide independent controlled-pressure air or controlled-pressure fluid pressures to the respective rotatable bellows spring device's sealed enclosed pressure chambers, wherein the flexible rotatable workpiece carrier plate bottom surface assumes a non-flat shapes at the location of each independent rotatable bellows spring device's sealed enclosed pressure chamber and the respective rotatable bellows spring device's sealed enclosed pressure chambers apply independently controlled abrading pressures to the portions of the at least one workpiece abraded surface that is positioned on the flexible rotatable workpiece carrier plate at the respective rotatable bellows spring device's sealed enclosed pressure chambers.

9. The apparatus of claim 1 where the rotatable workpiece carrier plate outer diameter outer periphery surface has a spherical shape.

10. The apparatus of claim 1 where the rotatable workpiece carrier plate outer diameter outer periphery surface has a spherical shape such that the spherical center of the rotatable workpiece carrier plate outer diameter outer periphery surface spherical shape is located at or near to the abraded surface of the at least one workpiece and rotatable roller idler outer shells periphery surface areas are spherical-shaped surfaces, wherein the centers of the rotatable roller idler spherical shape's spheres are respectively located at or near to the abraded surface of the at least one workpiece such that the rotatable workpiece carrier plate rotates with spherical-action about the spherical center of the rotatable workpiece carrier plate outer diameter outer periphery surface spherical shape sphere.

11. A process of providing abrading workpieces using an abrading machine workpiece substrate carrier apparatus comprising:

a) providing a movable nominally-horizontal stationary-positioned carrier housing having an outer periphery and an outer periphery area that is nominally-horizontal and is adjacent to the stationary-positioned carrier housing outer periphery and having rotary bearings that support a vertical hollow rotatable carrier drive shaft having a carrier drive shaft cross-section and a carrier drive shaft length and a carrier drive shaft axis of rotation that is concentric to the carrier drive shaft cross-section and extends along the length of the carrier drive shaft, wherein the carrier drive shaft is fixed vertically to the stationary-positioned carrier housing where the stationary-positioned carrier housing can be moved in a vertical direction;

b) providing a circular rotatable drive plate having a rotatable drive plate outer diameter, a rotatable drive plate top surface and an opposed rotatable drive plate bottom surface, wherein both the rotatable drive plate top surface and the rotatable drive plate bottom surface are nominally horizontal and the rotatable drive plate has a rotation axis that is perpendicular to the rotatable drive plate top surface and is located at the center of the rotatable drive plate top surface, wherein the rotatable drive plate top surface is attached to and is supported by the carrier drive shaft, and wherein the carrier drive shaft axis of rotation is concentric with the rotatable drive plate rotation axis;

c) providing a rotatable bellows spring device having multiple annular rings of flat-surfaced metal or polymers having annular ring outer diameters and annular ring inside diameters where adjacent annular rings are joined together at their outer diameters and adjacent annular rings are joined together at their inner diameters to form the rotatable bellows spring device, wherein the multiple individual annular rings are nominally horizontal and the individual annular rings are flexible in a vertical direction and where the rotatable bellows spring device has a rotatable bellows spring device top annular ring and a rotatable bellows spring device bottom annular ring and where the rotatable bellows spring device has a nominally-vertical axis of rotation that is perpendicular to the rotatable bellows spring device nominally-horizontal top annular ring and the rotatable bellows spring device axis of rotation is located at the center of the rotatable bellows spring device top annular ring wherein the rotatable bellows spring device can flex in a vertical direction;

d) providing the rotatable bellows spring device individual annular ring outer diameters as approximately the same and providing the rotatable bellows spring device individual annular ring outer diameters as approximately the same as the rotatable drive plate outer diameter, wherein the rotatable bellows spring device top annular ring is attached to the rotatable drive plate bottom surface such that the rotatable bellows spring device axis of rotation is nominally-coincident with the rotatable drive plate rotation axis;

e) providing a circular rotatable workpiece carrier plate having a rotatable workpiece carrier plate top surface and an opposed rotatable workpiece carrier plate flat bottom surface wherein both the rotatable workpiece carrier plate top surface and the rotatable workpiece carrier plate bottom surface are nominally horizontal and the rotatable workpiece carrier plate has a rotation axis that is perpendicular to the rotatable workpiece carrier plate top surface and is located at the center of the rotatable workpiece carrier plate top surface, wherein the rotatable workpiece carrier plate has a rotatable workpiece carrier plate outer diameter that is approximately the same as the rotatable bellows spring device individual annular ring outer diameters and wherein the rotatable workpiece carrier plate has a rotatable workpiece carrier plate thickness and a rotatable workpiece carrier plate outer periphery surface that is located at the rotatable workpiece carrier plate outer diameter and extends from the rotatable workpiece carrier plate top surface to the rotatable workpiece carrier plate flat bottom surface;

f) attaching the rotatable bellows spring device bottom annular ring to the rotatable workpiece carrier plate top surface so that the rotatable bellows spring device axis of rotation is nominally-coincident with the rotatable workpiece carrier plate rotation axis;

g) providing at least two roller idlers having respective stationary nominally-vertical roller idler shafts having respective stationary roller idler shaft lengths, wherein the respective at least two stationary roller idler shafts are attached to the stationary-positioned carrier housing outer periphery in the stationary-positioned carrier housing outer periphery area where the respective at least two stationary roller idler shafts support respective roller idler bearings that support respective rotatable roller idler shells where the respective rotatable roller idler outer shells have a roller idler outer shell periphery and a roller idler outer shell periphery surface area that is nominally-vertical, rotating the respective rotatable roller idler outer shells about a rotation axis that is concentric with the roller idler shafts and extend along the respective roller idler shafts lengths, wherein the respective rotation axes of the respective roller idler shafts are nominally-vertical;

h) attaching the at least two multiple roller idlers to the stationary-positioned carrier housing outer periphery area around the stationary-positioned carrier housing outer periphery wherein the at least two respective rotatable roller idler outer shells periphery surface areas are positioned in contact with the rotatable workpiece carrier plate outer diameter rotatable workpiece carrier plate outer periphery surface wherein the at least two multiple roller idlers are in rolling contact with the rotatable workpiece carrier plate outer periphery surface as the rotatable workpiece carrier plate is rotated and the at least two multiple roller idlers maintain the rotatable workpiece carrier plate rotation axis to be concentric with the carrier drive shaft axis of rotation as the rotatable workpiece carrier plate is being rotated;

i) providing at least one workpiece having parallel opposed flat workpiece top surfaces and flat workpiece bottom surfaces that are attached to the rotatable workpiece carrier plate flat bottom surface, wherein the at least one workpiece top surface is attached to the rotatable workpiece carrier plate flat bottom surface;

j) providing a rotatable abrading platen having a flat abrasive coated abrading surface that is nominally horizontal;

k) moving the stationary-positioned carrier housing vertically to position the flat workpiece bottom surface into flat-surfaced abrading contact with the rotatable abrading platen abrading surface and moving that the stationary-positioned carrier housing vertically to move the flat workpiece bottom surface from flat-surfaced abrading contact with the rotatable abrading platen abrading surface; and l) abrading the at least one workpiece.

12. The process of claim 11 where the rotatable bellows spring device top annular ring is attached to the rotatable drive plate bottom surface and the spring device bottom annular ring is attached to the rotatable workpiece carrier plate top surface, and creating a sealed enclosed pressure chamber formed in an internal volume that is contained by the rotatable bellows spring device, the rotatable drive plate bottom surface and the rotatable workpiece carrier plate top surface, and sealing the rotatable bellows spring device, the rotatable drive plate bottom surface and the rotatable workpiece carrier plate top surface by pressure and vacuum seals, wherein the rotatable drive attached to the rotatable drive plate bottom surface and the rotatable bellows plate bottom surface are pressure and vacuum sealed, and wherein the rotatable workpiece carrier plate top surface is pressure and vacuum sealed by introducing controlled-pressure air or controlled-pressure fluid or vacuum into the sealed enclosed pressure chamber through a fluid passageway that connects the hollow rotatable carrier drive shaft to the enclosed pressure chamber.

13. The process of claim 12 where the controlled-pressure air or controlled-pressure fluid in the sealed enclosed pressure chamber acts on the rotatable workpiece carrier plate top surface such that the controlled-pressure air or controlled-pressure fluid pressure is transmitted through the rotatable workpiece carrier plate thickness, wherein this controlled-pressure air or controlled-pressure fluid pressure is transmitted to the at least one workpiece that is attached to the rotatable workpiece carrier plate, wherein the controlled-pressure air or controlled-pressure fluid provides an abrading pressure which acts uniformly on the at least one workpiece being abraded and forces the at least one flat workpiece bottom surface into flat-surfaced abrading contact with the rotatable abrading platen abrading surface as the rotatable bellows spring device is flexed in a vertical direction by changing the pressure of the controlled-pressure air or controlled-pressure fluid in the sealed enclosed pressure chamber.

14. The process of claim 12 where controlled vacuum is applied to the sealed enclosed pressure chamber where the controlled vacuum negative pressure acts on the rotatable workpiece carrier plate top surface and compresses the rotatable bellows spring device which is flexed in a vertical direction by applying the controlled vacuum negative pressure in the sealed enclosed pressure chamber wherein the rotatable workpiece carrier plate is raised away from the rotatable abrading platen abrading surface.

15. The process of claim 11 where a flexible fluid or vacuum passageway tube is attached to the hollow rotatable carrier drive shaft and is routed to fluid passageways that are connected to fluid port holes in the rotatable workpiece carrier plate flat bottom surface, and vacuum is applied through the flexible fluid or vacuum passageway tube to attach flat-surfaced the at least one workpiece to the rotatable workpiece carrier plate flat bottom surface or controlled-pressure air or controlled-pressure fluid is applied through the flexible fluid or vacuum passageway tube to separate the attached flat-surfaced at least one workpiece from the rotatable workpiece carrier plate flat bottom surface.

16. The process of claim 11 where a flexible annular debris band that is impervious to water, abrading fluids and abrading debris comprises a flexible elastomer or polymer material and wherein the flexible annular debris band is attached to the rotatable drive plate and is attached to the rotatable workpiece carrier plate and the flexible annular debris band surrounds the outer diameter of the rotatable bellows spring device individual annular ring outer diameters, the flexible annular debris band blocking contamination of the rotatable bellows spring device individual annular rings by water, abrading fluids and abrading debris.

17. The process of claim 13 where a rotatable workpiece carrier plate is provided that is flexible in a vertical direction but is substantially rigid in a horizontal direction wherein portions of the rotatable workpiece carrier plate flat bottom surface can be distorted out-of-plane by the controlled-pressure air or controlled-pressure fluid that exists in the sealed enclosed pressure chamber which acts on the rotatable workpiece carrier plate top surface, wherein the controlled-pressure air or controlled-pressure fluid pressure is applied to the flexible rotatable workpiece carrier plate to cause the flexible rotatable workpiece carrier plate flat bottom surface to assume a non-flat shape.

18. The process of claim 17 where multiple rotatable bellows spring devices are provided that are positioned to be concentric with each other to form independent annular or circular rotatable bellows spring device's sealed enclosed pressure chambers sealed enclosed pressure chambers and sealed enclosed pressure chambers are formed between adjacent sealed enclosed pressure chambers, wherein each independent sealed rotatable bellows spring device sealed enclosed pressure chamber has an independent controlled-pressure air or controlled-pressure fluid source to provide independent controlled-pressure air or controlled-pressure fluid pressures to the respective rotatable bellows spring device's sealed enclosed pressure chambers, and the flexible rotatable workpiece carrier plate bottom surface assumes a non-flat shape at the location of each independent rotatable bellows spring device's sealed enclosed pressure chamber, wherein the respective rotatable bellows spring device's sealed enclosed pressure chambers apply independently controlled abrading pressures to the portions of the at least one workpiece abraded surface that is positioned on the flexible rotatable workpiece carrier plate at the location of the respective rotatable bellows spring device's sealed enclosed pressure chambers.

19. The process of claim 11 where the rotatable workpiece carrier plate outer diameter outer periphery surface has a spherical shape and the spherical center of the rotatable workpiece carrier plate outer diameter outer periphery surface spherical shape is located at or near to the abraded surface of the at least one workpiece and the rotatable roller idler outer shells periphery surface areas are spherical-shaped surfaces, wherein the centers of the rotatable roller idler spherical shape's spheres are respectively located at or near to the abraded surface of the at least one workpiece wherein the rotatable workpiece carrier plate are rotated with spherical-action about the spherical center of the rotatable workpiece carrier plate outer diameter outer periphery surface spherical shape sphere.

* * * * *